US005837953A

United States Patent [19]

Ito et al.

[11] Patent Number: 5,837,953

[45] Date of Patent: Nov. 17, 1998

[54] DC CIRCUIT BREAKING DEVICE

[75] Inventors: Hiroki Ito; Takashi Moriyama; Kenji Kamei; Minoru Kimura; Suenobu Hamano; Takashi Yonezawa; Etsuo Nitta; Kazuhiko Arai; Hiroyuki Sasao, all of Tokyo; Naoaki Takeji, Osaka; Takateru Hashimoto, Kagawa-ken; Masayuki Hatano, Tokyo, all of Japan

[73] Assignees: Mitsubishi Denki Kabushiki Kaisha, Chiyoda-ku; The Kansai Electric Power Co., Inc., Kita-ku; Shikoku Electric Power Co., Inc., Takamatsu; Electric Power Development Co., Ltd., Chuo-ku, all of Japan

[21] Appl. No.: 693,367

[22] Filed: Aug. 6, 1996

[30] Foreign Application Priority Data

Aug. 8, 1995 [JP] Japan ..... 7-202256

[51] Int. Cl.[6] ..... H01H 33/18

[52] U.S. Cl. ..... 218/30; 218/22

[58] Field of Search ..... 218/22, 23, 28, 218/30, 57, 65, 68, 87, 127–129

[56] References Cited

U.S. PATENT DOCUMENTS

| | | | |
|---|---|---|---|
| 846,340 | 3/1907 | Newell . | |
| 3,524,958 | 8/1970 | Frink | 200/148 |
| 3,980,850 | 9/1976 | Kimblin | 200/144 B |
| 4,207,446 | 6/1980 | Sasaki et al. | 200/148 B |
| 4,273,977 | 6/1981 | Kii | 200/147 R |
| 4,458,121 | 7/1984 | Yanabu et al. | 200/148 R |
| 4,560,848 | 12/1985 | Arimoto | 200/147 A |
| 4,786,770 | 11/1988 | Hamano et al. | 200/147 R |
| 4,851,622 | 7/1989 | Hosomi et al. | 200/148 A |

FOREIGN PATENT DOCUMENTS

| | | |
|---|---|---|
| 0 002 685 | 7/1979 | European Pat. Off. . |
| 0 014 393 | 8/1980 | European Pat. Off. . |
| 0 125 553 | 11/1984 | European Pat. Off. . |
| 0 130 590 | 9/1985 | European Pat. Off. . |
| 62-287531 | 12/1987 | Japan . |

OTHER PUBLICATIONS

Tokuyama, Shunji, et al., *Large DC Current Breaking by Commutating Method Using Negative Resistance Characteristic of Gas Arc*, Academy of Electric Engineering, Switch Protective Device Research Group, pp. 41–49. (English abstract provided).

Yoshio Yosida, et al., *A Study of DC–Current Interruption for GCB with Parallel Capacitor and Reactor,* Conference of the Power and Energy Department of the Electric Society (Japan, 1994), No. 621, pp. 824 and 825 (with an English abstract of the relevent portion).

*Primary Examiner*—Wynn Wood Coggins
*Assistant Examiner*—Michael J. Hayes
*Attorney, Agent, or Firm*—Burns, Doane, Swecker & Mathis, LLP

[57] ABSTRACT

A DC circuit breaking device is provided for interrupting the transmission of direct currents to an electric power system by making external changes to an arc generated upon contacting or separation of contacts 11 and 12 in order to rapidly extend and vibrate arc currents. In a self-excited commuting DC circuit breaking device, coils 41 and 42 opposed to a fixed and a movable contact 11 and 12, respectively, are disposed around the outer circumferences of the contacts 11 and 12, and currents flowing through a commutation circuit or the contacts 11 and 12 are allowed to flow through the opposed coils 41 and 42 so as to apply magnetic fields to the neighborhood of an arc. This constitution provides the DC circuit breaking device with high performance that it can rapidly extend and vibrate arc currents to thereby interrupt direct currents.

14 Claims, 22 Drawing Sheets

DC CIRCUIT BREAKING DEVICE

BACKGROUND OF THE INVENTION

1. Field of the Invention

The present invention relates to a DC circuit breaking device used for power in DC power transmission, and in particular, to a DC circuit breaking device for magnetically driving an arc generated upon separation of contacts in order to facilitate the extinction of the arc.

2. Description of Related Art

FIG. 29 is a circuit diagram of a general self-excited commuting DC circuit breaking device as shown in "Collection of Papers Presented at the Conference of the Power and Energy Department of the Electric Society in 1994 (Papers 11)" No. 621, pp. 824 and 825. In this figure, the self-excited commuting DC circuit breaking device comprises a DC circuit breaking device 1, a parallel reactor 2 and a parallel condenser 3 which constitute a commutation circuit, a surge absorber 4 connected in parallel to the parallel reactor 2 and condenser 3 for absorbing the overvoltage of the parallel condenser 3, and a DC line 5 for an electric power system. The surge absorber 4 may be simply connected in parallel to the parallel condenser 3.

FIG. 30 is a cross sectional view of the integral part of a conventional self-excited commuting DC circuit breaking device that uses a puffer-type gas circuit breaker. Reference numeral 1 designates a DC circuit breaker that has a fixed contact 11 and a movable contact 12 that conduct direct currents. Reference numeral 2 denotes a parallel reactor one end of which is connected to the fixed contact 11 of the DC circuit breaker 1. Reference numeral 3 indicates a parallel condenser one end of which is connected to the other end of the parallel reactor 2, with the other end connected to the movable contact 12 of the DC circuit breaker 1. The movable contact 12 has an insulating nozzle 14 fixed thereto together with a puffer cylinder 13. The movable contact 12 has a piston rod 15 directly connected thereto which is withdrawn, pushed, and moved by an operating mechanism 16. Reference numeral 17 designates a fixed puffer piston, and 18 is a gas effluence port from which $SF_6$ gas is jetted against an arc 19 when its pressure is increased in a puffer chamber surrounded by the movable contact 12, the puffer cylinder 13, and the puffer piston 17. Reference numeral 20 denotes a fixed-side pullout conductor connected to the fixed contact 11, and 21 is a movable-side pullout conductor connected to the movable contact 12.

Next, the operation is described. In this puffer-type gas circuit breaker, when the operating mechanism 16 is used to pull out the piston rod 15, the fixed contact 11 and the movable contact 12 are parted to generate an arc 19 therebetween. The puffer piston 17 then operates to increase the pressure of the $SF_6$ gas in the puffer chamber within the puffer cylinder 13, which is then jetted from the gas effluence port 18 against the arc 19. Direct currents, however, do not periodically cross the current zero point as in alternating currents, so in this case, the currents cannot be interrupted easily simply by jetting the $SF_6$ gas against the DC arc. Thus, by connecting the parallel reactor 2 and the parallel condenser 3 in parallel to the DC circuit breaker 1 to commute currents to the commutation circuit, while using the interaction of the parallel reactor 2 and condenser 3 and the voltage and current negative characteristics of the so arc, it expands the arc voltage and current oscillation to form the current zero point, the $SF_6$ gas, the pressure of which has been increased by the puffer piston 17, is jetted from the gas effluence port 18 against the arc 19 via the insulating nozzle 14 to extinguish the arc.

FIG. 31 is a partial cross sectional view showing the parting of contacts in a conventional switch as shown in, for example, Japanese Patent Application Laid Open No. 62-287531. In this figure, 22 is a terminal, 23 is a finger-like fixed contact secured to the terminal 22, and 24 is a movable contact that moves on the axis to make contact with or leave the fixed contact 23. Reference numeral 25 denotes an outer casing located outside the fixed contact 23, one end of which is secured to the terminal 22 and which has an opening at the other end, 26 is an insulating nozzle one end of which is secured to the opening of the outer casing 25 and which has at the other end a through-hole 27, into which the movable contact 24 can be inserted. Reference numeral 28 indicates a annular permanent magnet provided outside the insulating nozzle 26, 29 is an accumulator surrounded by the terminal 22 and the outer casing 25 and formed between them and the fixed contact 23, and 30 is a communication section through which an insulating arc-extinguishing gas passes to the accumulator 29. Reference numeral 31 is an arc generated when the movable contact 24 parts from the fixed contact 23.

Next, the operation is described. In the contacting state, the end of the movable contact 24 is inserted into the fixed contact 23 and slidably contact with it. An electric current flows from the terminal 22 to the movable contact 24 through the fixed contact 23. During the contact parting operation, when the movable contact 24 is driven by a drive mechanism (not shown) on the axis in the direction shown by arrow A, the movable contact 24 parts from the fixed contact 23, and an arc 31 is generated between both contacts 23 and 24.

On the other hand, the permanent magnet 28 provided outside the insulating nozzle 26 is magnetized so as to generate lines of magnetic force $\phi$, as shown in the figure, and has radial magnetic field components near the end of the fixed contact 23. Thus, the interaction between radial magnetic fields and the arc 31 causes the arc near the end of the fixed contact 23 to be rotationally driven in the direction of the circumference of the fixed contact 23 and to be extended toward the accumulator 29 due to a centrifugal force.

When the current phase of the arc 31 is near its peak, the insulating arc-extinguishing gas, heated by the arc 31, has its pressure increased due to expansion and thermal dissociation, and flows through the communication section 30 into the accumulator 29, where it is accumulated. When the current phase is near its zero point, the arc 31 has both its diameter and temperature reduced to reduce the gas pressure near itself, thereby causing the insulating arc-extinguishing gas to be jetted from the accumulator 29 toward itself through the communication section 30, resulting in its extinction.

The conventional switch including the accumulator which uses magnetic fields to drive the arc 31 in the direction of the circumference of both contacts 23 and 24 in order to interrupt alternating currents has been described.

In the self-excited commuting DC circuit breaking device shown in FIGS. 29 and 30, the parallel reactor and condenser play an important roll in extending, vibrating and commuting arc currents to commute them. To extend and vibrate the arc current, however, rapid changes must be made to the current.

This invention is proposed to solve the above problem, and its objective is to provide a DC circuit breaking device that makes rapid changes to arc currents so as to extend and vibrate them in order to interrupt the direct currents.

In addition, the conventional magnetically driven switch shown in FIG. 31 is effective in interrupting alternating currents having a current zero point, but in the case of a switch used for high-voltage power system such as DC power transmission to interrupt direct currents, the conventional magnetic drive method does not provide sufficient arc voltages and cannot interrupt the currents well.

This invention is proposed to solve the above problem, and its objective is to provide a DC circuit breaking device that generates high arc voltages and which has an excellent DC circuit breaking performance.

BRIEF SUMMARY OF THE INVENTION

According to a first invention, there is provided a DC circuit breaking device comprising: a DC circuit breaker having a fixed and a movable contacts to interrupt the transmission of direct currents to an electric power system; a commutation circuit connected in parallel to the DC circuit breaker and having a parallel condenser and a parallel reactor; a surge absorber connected in parallel across the commutation circuit for absorbing a surged voltage applied to the parallel condenser; and a coil means disposed in an opposed relation to at least one of the fixed and movable contacts around the outer circumference of the at least one contact so as to apply magnetic fields to an arc generating area formed upon separation of the contacts.

According to a second invention, a pair of coils are disposed in an opposed relation to the fixed and movable contacts, respectively, around the outer circumference of the contacts, the coils being wound in the opposite directions with respect to each other, and cusp magnetic fields are applied to the arc generating area formed upon separation of the contacts.

According to a third invention, a pair of coils are disposed in an opposed relation to the fixed and movable contacts, respectively, around the outer circumference of the contacts, the coils being wound in the same direction, and mirror magnetic fields are applied to the arc generating area formed upon separation of the contacts.

According to a fourth invention, currents flowing through the commutation circuit is allowed to flow through the coil means disposed around the outer circumference of at the least one contact in order to apply magnetic fields to the arc generating area.

According to a fifth invention, currents flowing through the at least one fixed or the movable contact is allowed to flow through the coil means disposed around the outer circumference of the at least one contact in order to apply magnetic fields to the arc generating area.

According to a sixth invention, currents flowing through the commutation circuit are allowed to flow through the coil means disposed around the outer circumference of the at least one contact, while currents flowing through the other contact is allowed to flow through the coil means disposed around on the outer circumference of the other contact, thereby applying magnetic fields to the arc generating area.

According to a seventh invention, the coil means constitutes the parallel reactor of the commutation circuit.

According to an eighth invention, a first tank is provided in which the DC circuit breaker and the coil means are housed.

According to a ninth invention, a second tank with a tank closing door is provided which is connected to the first tank for housing the parallel condenser therein.

According to a tenth invention, $SF_6$ gas is filled in the first tank, and the second tank is isolated from the first tank via a partition means, and has air filled therein.

According to an eleventh invention, at least one of the fixed and movable contacts takes the shape of a cylinder with a spiral slit formed therethrough so as to apply magnetic fields to the arc generating area formed upon separation of the contacts.

According to a twelfth invention, each of the fixed and the movable contacts takes the shape of a cylinder with a spiral slit, the spiral slits being formed in the opposite directions with respect to each other, and cusp fields are applied to the arc generating area formed upon separation of the contacts.

According to a thirteenth invention, each of the fixed and the movable contacts takes the shape of a cylinder with a spiral slit formed therethrough, the spiral slits being formed in the same direction, and mirror fields are applied to the arc generating area formed upon separation of the contacts.

According to a fourteenth invention, each of the fixed and the movable contacts takes the shape of a cylinder with a spiral slit formed therethrough, one of the cylinders being slidably inserted into the other, and a plurality of pleat-like protrusions are formed on the sliding surfaces of the cylinders.

According to a fifteenth invention, there is provided a DC circuit breaking device comprising: a first and a second contact disposed in an opposed relation with respect to each other so as to be movable toward and away from each other along an axis; a first magnet disposed near the outer circumference of a contacting-side end of the first contact in a concentric relation to the axis with its N and S magnetic poles arranged in a direction in which the contacts relatively move toward and away from each other; and a second magnet disposed near the outer circumference of a contacting-side end of the second contact so as to be concentric relative to the axis with its N and S magnetic poles arranged in the same direction as the first magnet.

According to a sixteenth invention, the first magnet is disposed near the outer circumference of the contacting-side end of the first contact so as to be concentric relative to the axis when the contacts are fully separated from each other.

According to a seventeenth invention, the first magnet is disposed on a line extending from the contacting-side end of the first contact perpendicularly to the direction in which the first and second contacts move toward and away from each other, whereas the second magnet is disposed on a line extending to the contacting-side end of the second contact perpendicularly to the direction in which the first and second contacts move toward and away from each other.

According to an eighteenth invention, an insulating barrier is provided between the first contact and the first magnet and between the second contact and the second magnet.

According to a nineteenth invention, a magnetic substance is located on the outer circumferences of the first and second magnets for coupling the different magnetic poles of the magnets which are disposed on the opposite side of their inner opposed magnetic poles.

According to a twentieth invention, there is provided a puffer type DC circuit breaking device comprising: a fixed contact; a movable contact being movable toward and away from the fixed contact along an axis, the movable contact having a through-hole at an axial center thereof; a cylinder operatively connected with the movable contact; a piston fixed to a fixed portion and slidably received in the cylinder so as to define a puffer chamber; a gas port provided on the puffer chamber and being in communication with the through-hole in the movable contact for discharging the gas inside the puffer chamber toward the movable contact; an insulating barrier located outside the movable contact and having at one end thereof a throat portion through which the fixed contact penetrates, with the other end thereof fixed to the cylinder; a first magnet disposed on the outer circumferential surface of the insulating barrier located near a contacting-side end of the movable contact in a concentric relation to the axis with its N and S magnetic poles arranged in the direction in which the contacts move toward and away from each other; and a second magnet disposed on the outer circumferential surface of the insulating barrier located near the contacting-side end of the fixed contact when the movable contact is fully separated from the fixed contact, so as to be concentric relative to the axis with its poles arranged in the same polarities as the first magnet in the direction in which the contacts move toward and away from each other.

According to the first invention, an opposed coil opposed to at least one of the fixed and the movable contacts is disposed around the outer circumference of the contact so as to apply magnetic fields to the neighborhood of an arc. The arc voltage is thus varied to cause the arc current to be rapidly extended and vibrated in order to interrupt the currents.

According to the second invention, since the first and the second opposed coils are wound in the opposite directions, cusp fields can be applied to the arc generating area formed upon separation of the contacts.

According to the third invention, since the first and the second opposed coils are wound in the same direction, mirror fields can be applied to the arc generating area formed upon separation of the contacts.

According to the fourth invention, currents flowing through the commutation circuit are allowed to flow through the opposed coil in order to apply magnetic fields to the arc generating area. Thus, the commuting current becomes larger as the arc current becomes smaller, so the reduced arc is radially extended by a large force (magnetic fields). Consequently, the circuit breaking performance is improved.

According to the fifth invention, currents flowing through the contact are allowed to flow through the opposed coil in order to apply magnetic fields to the arc generating area. Thus, larger magnetic fields are applied when the arc current is large, thereby allowing an arc of a large current to be extended easily. Consequently, the circuit breaking limit current of the DC current breaker is increased.

According to the sixth invention, currents flowing through the commutation circuit are allowed to flow through one of the opposed coils, while currents flowing through the contact are allowed to flow through the other, thereby applying magnetic fields to the arc generating area. Thus, when different currents passing through the contact and the commutation circuit, respectively, are used to apply magnetic fields, so the external force acting on the arc varies complicatedly to increase the circuit breaking limit current of the DC circuit breaker.

According to the seventh invention, since the opposed coil constitutes the parallel reactor of the commutation circuit, both the magnetic field application function and the effects of the parallel reactor are provided.

According to the eighth invention, the DC circuit breaker is housed inside the tank, and the opposed coil is also housed inside the tank. The overall DC circuit breaking device is thus compact, producing few adverse effects on the environment.

The ninth invention includes the second tank with the tank closing door connected to the first tank for housing the parallel condenser inside the second tank. The overall DC circuit breaking device is thus compact, producing few adverse effects on the environment. The closing door enables the maintenance of the parallel condenser to be conducted easily.

According to the tenth invention, $SF_6$ gas is filled in the first tank for the DC circuit breaker, and the second tank is isolated from the first tank via a flange, and has air filled therein. As a result, the inside of the second tank can be inspected easily.

According to the eleventh invention, at least one of the fixed and the movable contacts is shaped like a cylinder with a spiral slit, so arc currents generated by the contacts on their parting are used to apply magnetic fields to the arc generating area.

According to the twelfth invention, the fixed and the movable contacts are each shaped like a cylinder with a spiral slit, and each spiral slit is formed in the opposite direction to the other's. Arc currents generated by the contacts on their parting are thus used to apply cusp fields to the arc generating area.

According to the thirteenth invention, the fixed and the movable contacts are each shaped like a cylinder with a spiral slit, and the spiral slits are formed in the same direction. Arc currents generated by the contacts on their parting are thus used to apply mirror fields to the arc generating area.

According to the fourteenth invention, pleat-like protrusions are formed on the sliding surfaces of the cylindrical contacts with a spiral slit, ensuring that electricity is conducted through the fixed and the movable contacts.

According to the fifteenth invention, the first and the second magnets are disposed near the outer circumference of the ends of the first and the second contacts in such a way that their poles are arranged in the contacting direction and that the respective poles are arranged in the same direction. Thus, immediately after the initiation of parting, magnetic fields from both magnets and the arc interact. As the parting proceeds, radial magnetic fields from the first magnetic and the arc interact at the end of the first contact, while radial magnetic fields from the second magnetic and the arc interact at the end of the second contact. In addition, magnetic fields parallel with the axis and the arc interact between the contacts. The arc is thus rotated at its either end in the circumferential direction of the contacts but in the opposite directions, and thus spirally twisted. Furthermore, the middle of the arc is magnetically driven to be radially extended.

According to the sixteenth invention, the first magnet is disposed near the outer circumference of the end of the first contact, and the second magnet is disposed near the outer circumference of the end of the second contact as fully parted from the first contact, in such a way that their poles are arranged in the contacting direction and that the respective poles are arranged in the same direction. Thus, near the end of the first contact, the arc interacts with radial magnetic fields from the first magnets, and is rotationally driven in one circumferential direction, whereas near the end of the second contact, the arc interacts with radial magnetic fields from the second magnets, and is rotationally driven in the other circumferential direction. Between the contacts, the arc also interacts with radial magnetic fields, and is magnetically driven to be radially extended. As a result, the arc is spirally twisted, while radially and outwardly extended.

According to the seventeenth invention, the first magnet is disposed on a line radially extending from the end of the first contact, while the second magnet is disposed on a line radially extending from the end of the second contact.

Consequently, radial magnetic fields from the magnets efficiently act on the neighborhood of the ends of the contacts, causing the arc to be rotated at its either end in the circumferential direction of the contacts but in the opposite directions and to be spirally twisted. Furthermore, the middle of the arc is radially extended.

According to the eighteenth invention, the insulating barrier is provided between the contact and the magnet, so each magnet is prevented from being exposed to the hot arc that has been spirally and radially extended.

According to the nineteenth invention, since a magnetic path is formed by using the magnetic substance to couple the first and the second magnets, magnetic fields from both magnets which act on the arc are strengthened, thereby enhancing the magnetic driving force that is provided by the interaction of magnetic fields and the arc generated between the contacts and which drives the arc so as to be spirally and radially extended.

The twentieth invention provides the puffer-type DC circuit breaking device wherein the first magnet is disposed on the outer circumferential surface of the insulating barrier located near the end of the movable contact, while the second magnet is disposed on the outer circumferential surface of the insulating barrier located near the end of the fixed contact when the movable contact is fully parted, in such a way that the poles of both magnets are arranged in the contacting direction and that the respective poles are arranged in the same direction. The interaction of magnetic fields and the arc generated between the contacts causes the arc to be rotated at its either end in the circumferential direction of the contacts but in the opposite directions and to be spirally twisted, with the middle of the arc magnetically driven to be radially extended. In addition, the gas in the puffer chamber is jetted against the magnetically and spirally driven arc, which is further radially extended and cooled.

DETAILED DESCRIPTION OF THE PREFERRED EMBODIMENTS

Embodiment 1

Figure 1:
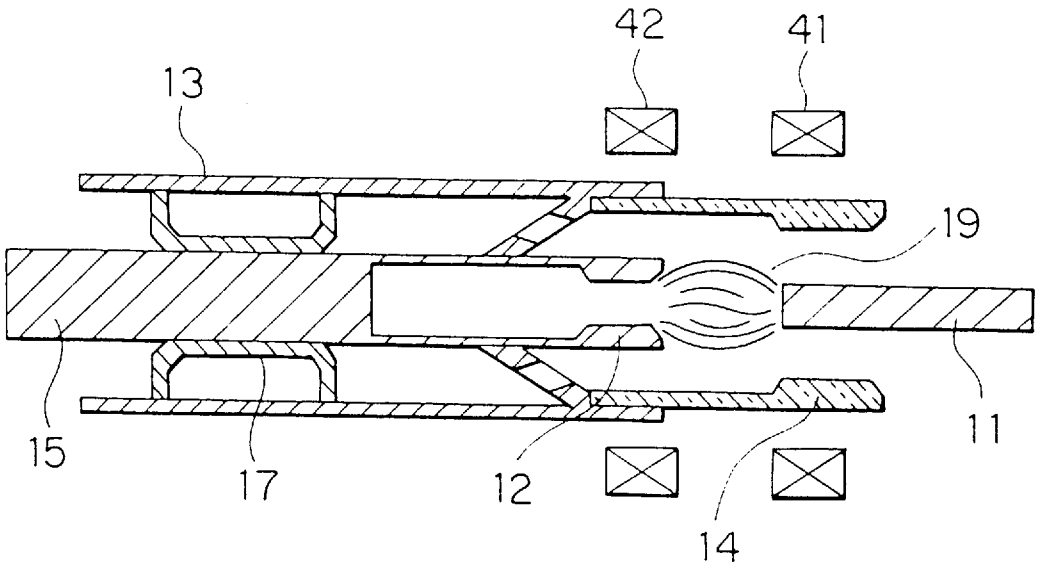
FIG. 1 is a cross sectional view showing an arc-extinguishing chamber of a DC circuit breaking device according to a first invention of this invention.
Figure 30:
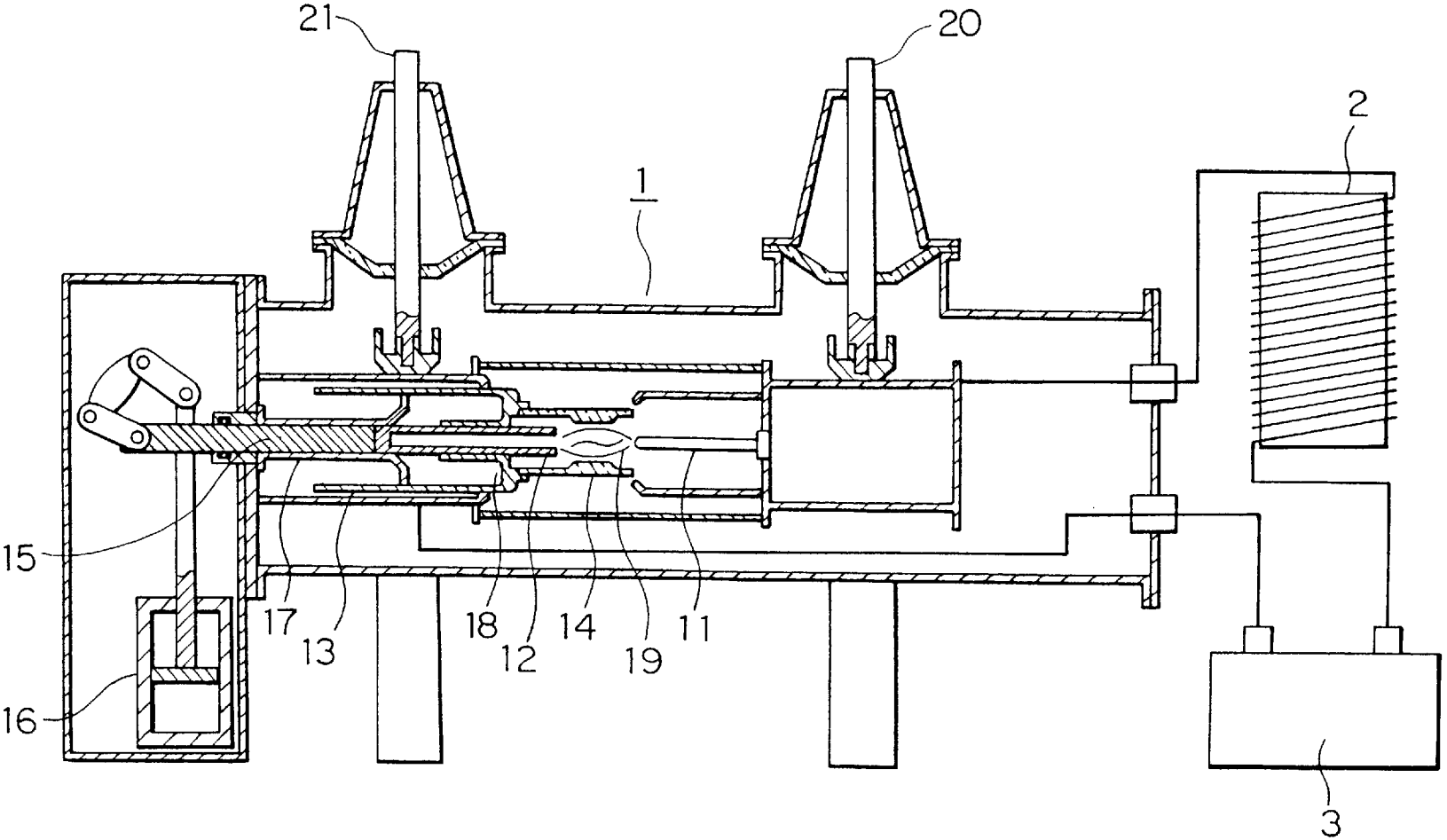
FIG. 30 PRIOR ART
FIG. 30 is a cross sectional view showing the integral part of a conventional self-excited commuting DC circuit breaking device.
Figure 31:
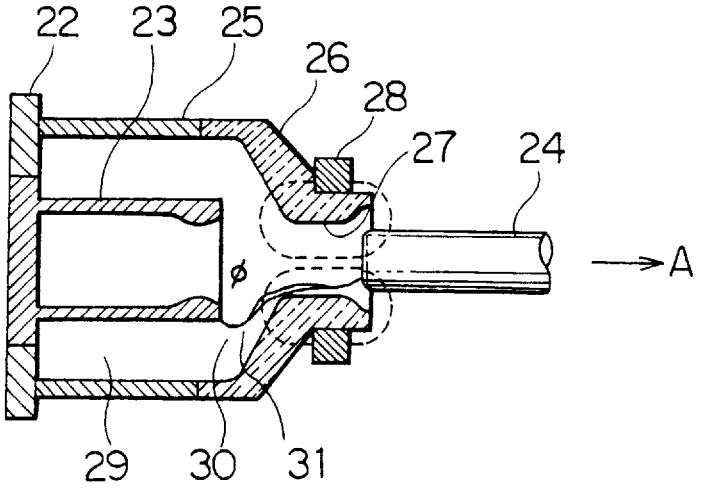
FIG. 31 PRIOR ART
FIG. 31 is a partial cross sectional view showing the parting of contacts in a conventional switch.

A first embodiment of this invention is described below. FIG. 1 is a cross sectional view of an arc-extinguishing chamber of a DC circuit breaking device according to the first embodiment of this invention. In this figure, 11 and 12 are a fixed and a movable contact, respectively, which move on the axis to make contact or part. Reference numeral 13 designates a puffer cylinder, 14 is an insulating nozzle, 15 is a piston rod, 17 is a puffer piston, and 19 is an arc. The same reference numerals as in FIG. 30 indicate identical or equivalent parts, and this is applicable to each of the following embodiments. Reference numeral 41 denotes a first opposed coil disposed near the outer circumference of the contacting-side end of the fixed contact 11 so as to be concentric relative to the axis of the contact 11. Reference numeral 42 designates a second opposed coil disposed near the outer circumference of the contacting-side end of the movable contact 12 so as to be concentric relative to the axis of the contact 12 when the contacts are fully parted. Both opposed coils effectively apply magnetic fields to an arc generating area formed upon separation of the contacts.

Next, the operation is described. The first and the second opposed coils 41 and 42 opposed to the fixed and the movable contacts 11 and 12, respectively, are disposed around the outer circumference of these contacts 11 and 12 so as to apply magnetic fields to the neighborhood of an arc. This constitution enables the provision of a DC circuit breaking device of high performance which enables the application of strong and varying magnetic fluxes and wherein the application of required magnetic fields can vary the arc voltage to cause the arc current to be extended and vibrated rapidly, thereby interrupting direct currents. Compared to permanent magnets, coils can generate those magnetic fluxes which suffer few temporal changes, and compact coils enable the application of stronger magnetic fields. When coils are used to apply magnetic fields, the variation of magnetic fields may vary the radius of spirally moving arc electrons or the length of the extended arc. This variation rapidly changes the arc resistance to enable the arc to easily transfer to a mode in which vibrations are likely to occur.

The basis of the operation is described. The circuit breaking performance can be effectively improved by increasing the length of an arc generated between the contacts 11 and 12 as well as the arc voltage. To extend the arc, the effective flight length of electrons in arc plasma (ions and electrons) may be increased. To do this, electric and magnetic fields must cross each other. When electric and magnetic fields cross each other, electrons move perpendicularly to electromagnetic fields while performing a spiral movement called a trochoid. Thus, to extend the arc to obtain a sufficient flight length, a method for applying axial or radial magnetic fields to the arc may be used.

Figure 2:
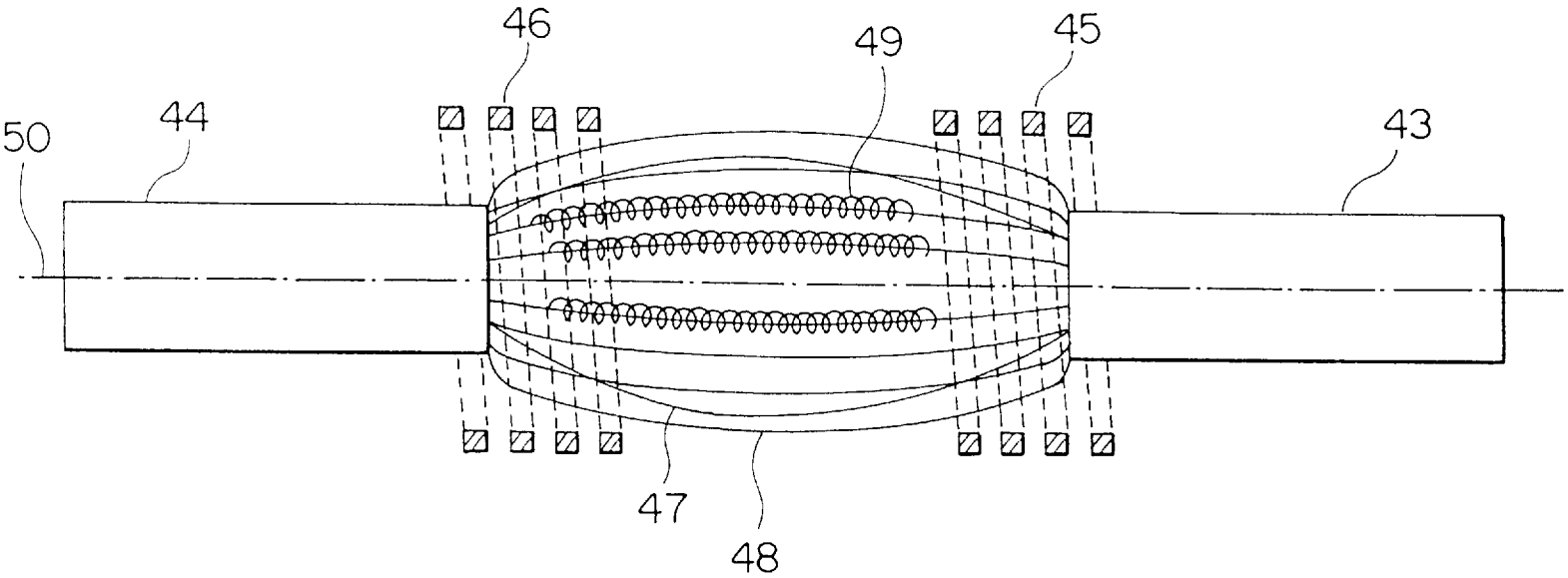
FIG. 2 is an explanatory drawing showing the movement of electrons in an arc when two coils of the same polarity are used to apply mirror magnetic fields.

FIG. 2 is an explanatory drawing showing the movement of electrons in an arc when two opposed coils of the same polarity (the coils are wound in the same direction) are used to apply mirror magnetic fields to the arc. Reference numerals 43 and 44 designate contacts, 45 and 46 are coils, 47 is an arc, 48 is a line of magnetic force of a mirror magnetic field, and 49 is an orbit of an electron of the arc. Reference numeral 50 indicates an axis on which the contacts move.

Magnetic fluxes of mirror magnetic fields penetrate the coils in such a way that they are swollen between the coils. Consequently, electrons in the arc in the mirror magnetic field move along the line of magnetic force while spirally moving on a plane perpendicular to the line of magnetic force, so the flight length of arc electrons is substantially long, and the shape of the arc is radially extended, compared to the case without magnetic fields. The extended arc increases the rate at which the arc current and the voltage vibration are increased, thereby improving the circuit breaking performance.

Figure 3:
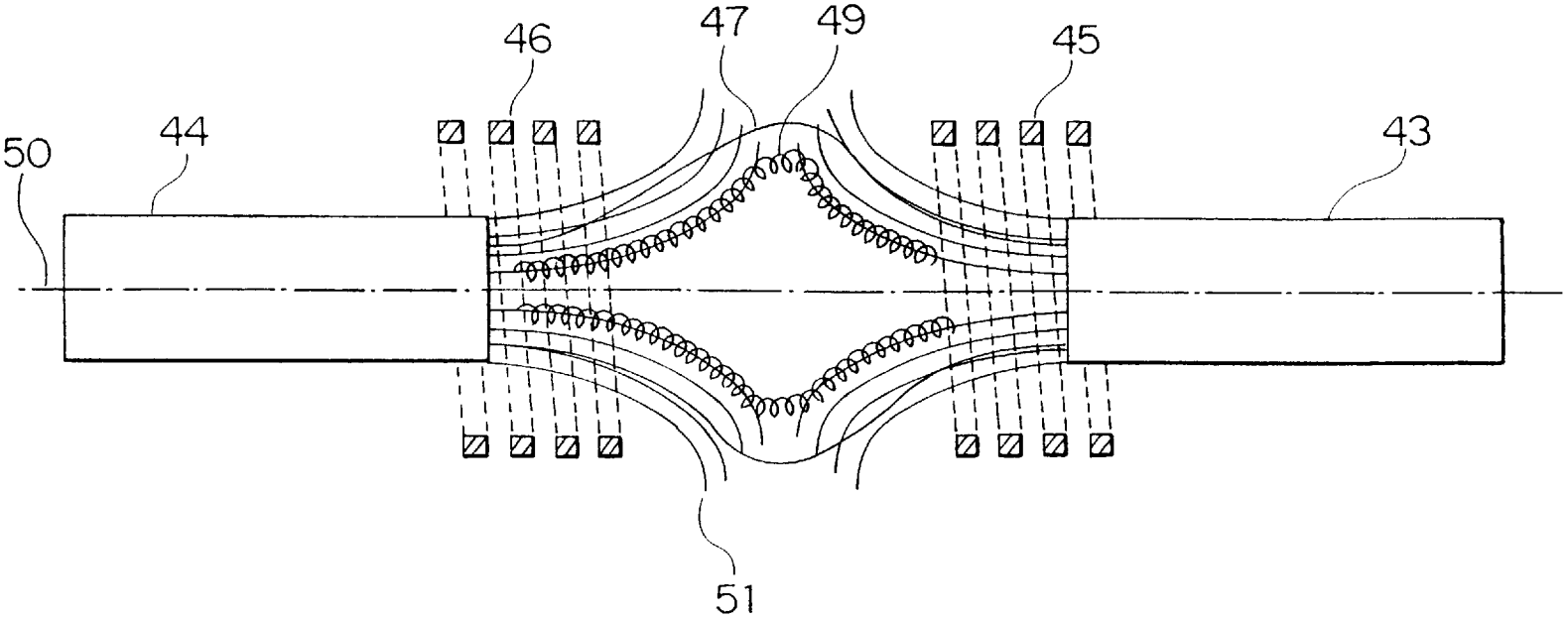
FIG. 3 is an explanatory drawing showing the movement of electrons in an arc when two coils of different polarities are used to apply cusp magnetic fields.

FIG. 3 is an explanatory drawing showing the movement of electrons in an arc when two opposed coils of different polarities (the coils are wound in different directions) are used to apply cusp magnetic fields to the arc. In this figure, 51 is a line of magnetic force of a cusp magnetic field. Magnetic fluxes of cusp magnetic fields radially extend in such a way that they repel each other between the two coils. Thus, electrons in the arc in the cusp magnetic field extend along the line of magnetic force and perpendicularly to arc (radial direction) while spirally moving on a plane perpendicular to the line of magnetic force, so the flight length of arc electrons is substantially long, and the shape of the arc is axially extended, compared to the case without magnetic fields.

As in the application of mirror magnetic fields, the circuit breaking performance is improved when the arc voltage is increased by the extended arc compared to the case without magnetic fields. Since the arc inherently attempts to flow between the contacts, it is significantly varied when axially moving. This variation rapidly varies the arc resistance to cause the arc to enter a mode in which vibrations are likely to occur. This in turn causes the arc to be extended and vibrated, so the arc can be interrupted easily.

Embodiment 2

Figure 4:
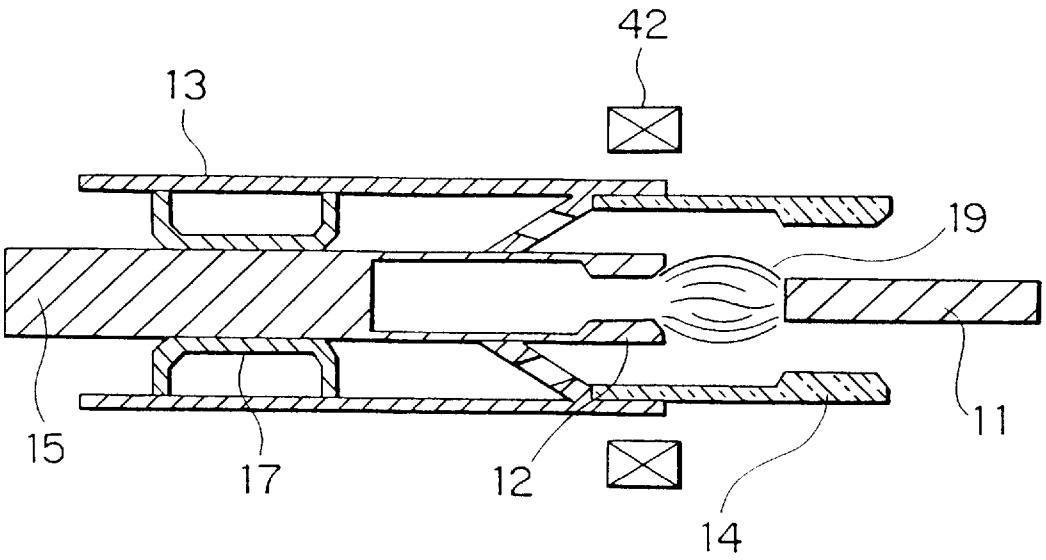
FIG. 4 is a cross sectional view showing an arc-extinguishing chamber of a DC circuit breaking device according to a second invention of this invention.

FIG. 4 is a cross sectional view of an arc-extinguishing chamber of a DC circuit breaking device according to a second embodiment of this invention. An opposed coil is disposed near the outer circumference of the contacting-side end of either the fixed contact 11 or the movable contact 12 so as to be concentric relative to the axis of the contacts when the contacts are fully parted. In this embodiment, the opposed coil 42 is disposed around the outer circumference of the movable contact.

Figure 29:
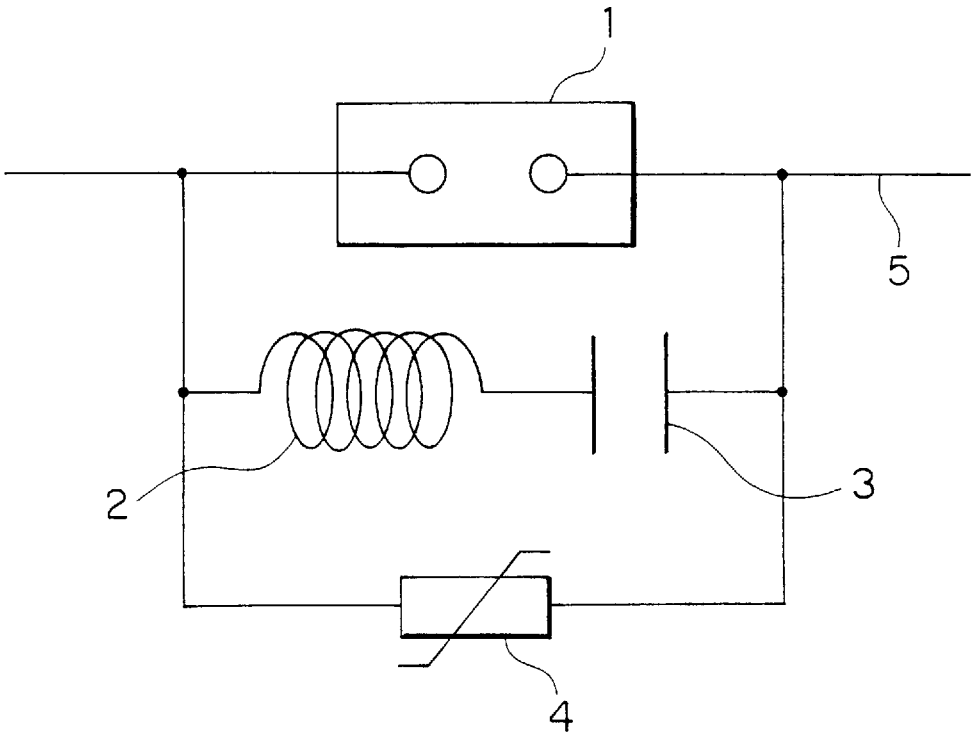
FIG. 29 PRIOR ART
FIG. 29 is a circuit diagram showing a general self-excited commuting DC circuit breaking device.

Although not shown in FIGS. 1 and 4, a parallel reactor 2, a parallel condenser 3, and a surge absorber 4 shown in FIG. 29 are also connected to this device.

The operation is described. The opposed coil 42 opposed to at least one of the fixed and the movable contacts 11 and 12 is disposed around the outer circumference of the contact so as to apply magnetic fields to the neighborhood of the arc. This constitution enables the provision of a DC circuit breaking device of high performance which enables the application of strong and varying magnetic fluxes and wherein the application of required magnetic fields can vary the arc voltage to cause the arc current to be extended and vibrated rapidly, thereby interrupting direct currents. Compared to permanent magnets, coils can generate those magnetic fluxes which suffer few temporal changes, and compact coils enable the application of stronger magnetic fields.

Embodiment 3

Figure 5:
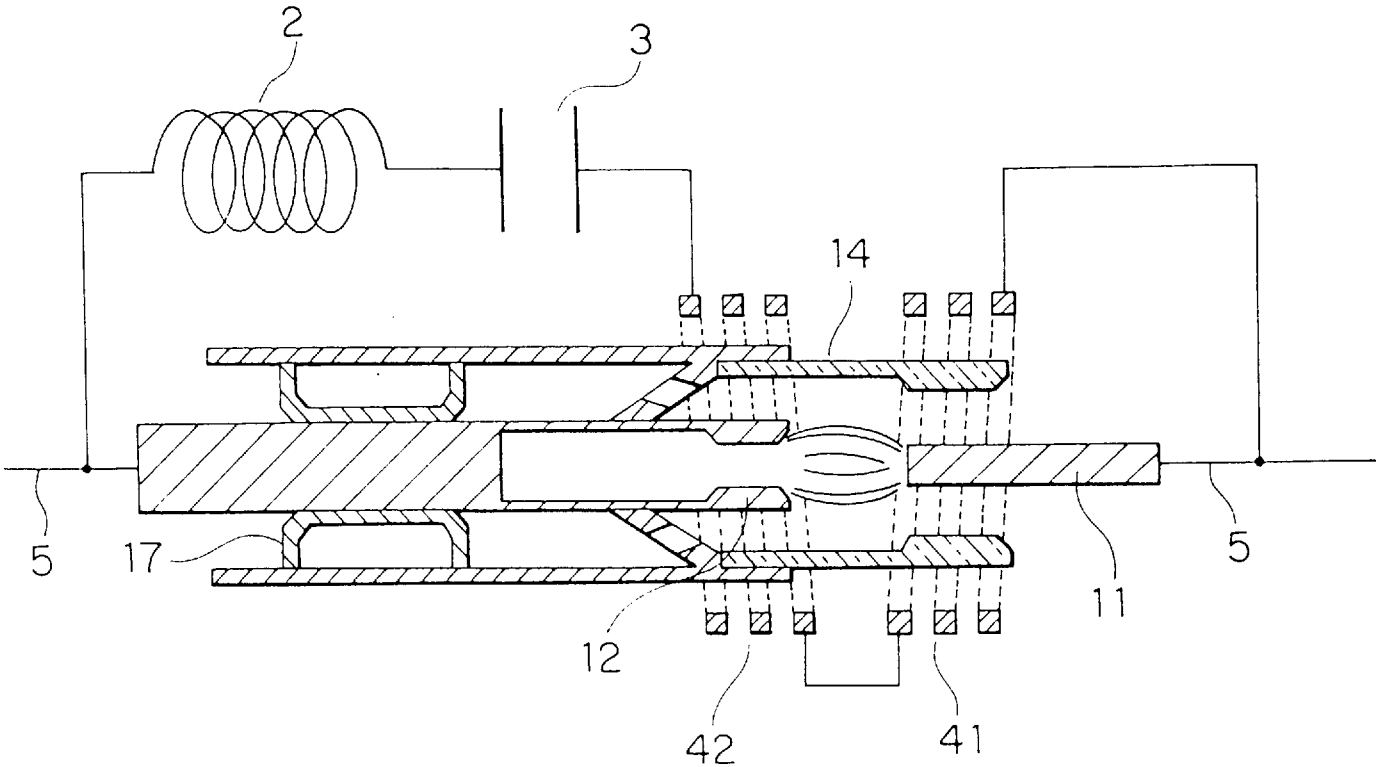
FIG. 5 is a cross sectional view showing an arc-extinguishing chamber of a DC circuit breaking device according to a third invention of this invention.

FIG. 5 is a cross sectional view showing the integral part of a DC circuit breaking device according to a third embodiment of this invention. In this figure, the first and the second opposed coils 41 and 42 disposed around the outer circumference of the fixed and the movable contacts 11 and 12 are wound in the opposite directions. The parallel reactor 2 and the parallel condenser 3 are components of the commutation circuit of the DC circuit breaker, and the lines are connected so that currents flowing through the parallel reactor 2 and the parallel condenser 3 are allowed to flow to a DC line via the first and the second opposed coils 41 and 42. In this case, the first and the second opposed coils 41 and 42 constitute part of the parallel reactor of the commutation circuit.

Next, the operation is described. When currents passing through the commutation circuit comprising the reactor 2 and the parallel condenser 3 and varying sinusoidally are allowed to flow through the first and the second opposed coils 41 and 42, magnetic fields applied vary periodically, and an external force applied to the arc (thus, the arc voltage)

also varies. Due to the variation of the external action, the extension and vibration of arc currents is initiated. In this manner, while currents are commuted to the commutation circuit, arc currents are oscillated so as to approach their zero point, and the puffer piston 17 is used to increase the pressure of $SF_6$ gas in order to jet it against the arc from the insulating nozzle 14, thereby extinguishing the arc. In particular, if currents flowing through the commutation circuit are allowed to flow through the coil and magnetic fields are applied, then the circuit breaking performance is improved because the commuting current becomes larger as the arc (the arc current) becomes smaller, and because the reduced arc is radially extended by a large force (magnetic fields). In FIG. 5, cusp magnetic fields are applied by the commuting current.

Figure 6:
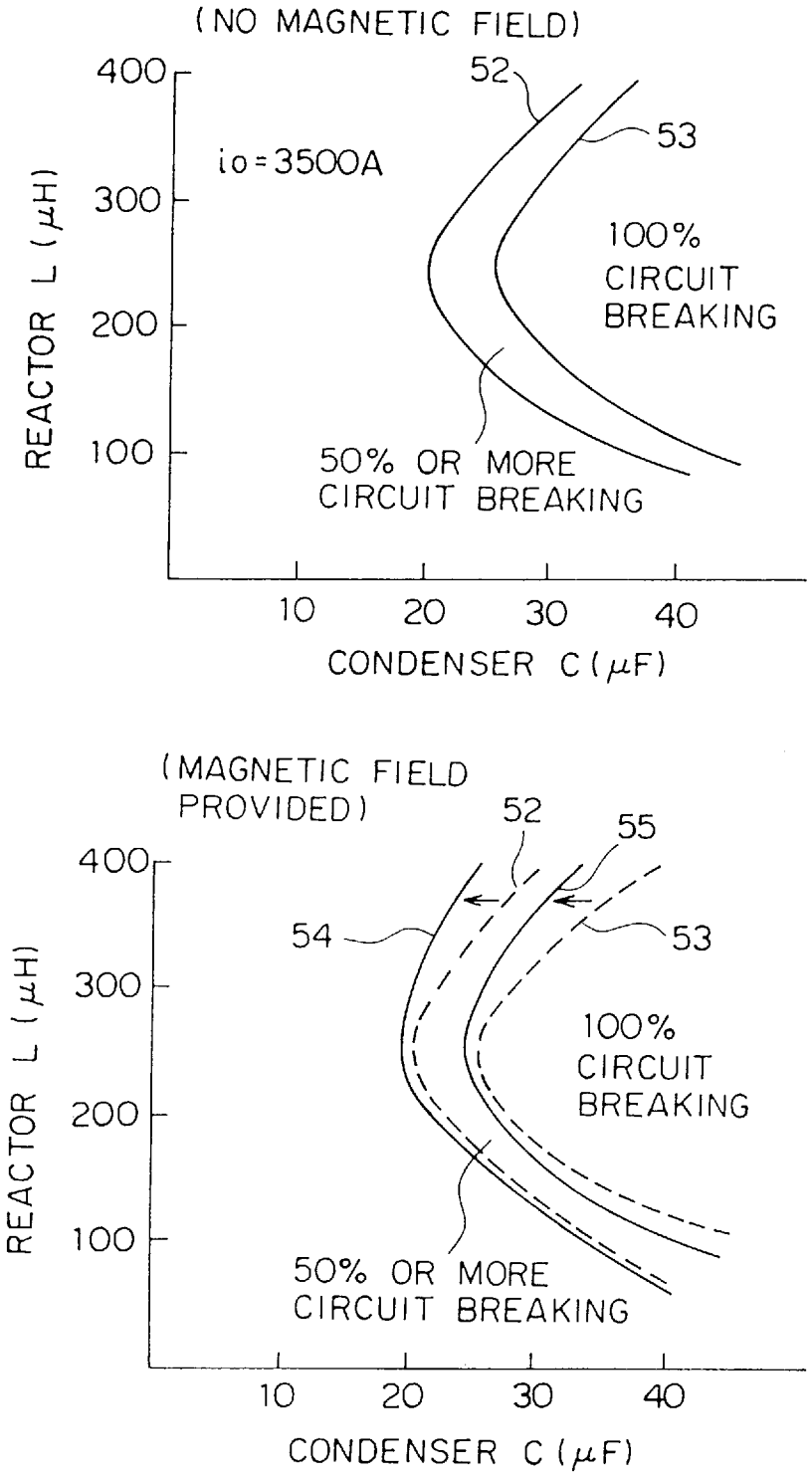
FIG. 6 shows the circuit breaking performance depending on the presence of magnetic fields.

FIG. 6 shows the circuit breaking performance depending on the presence of magnetic fields. A case without magnetic fields is shown in, for example, the conventional example in FIG. 30, whereas a case with magnetic fields is shown in FIG. 5 for a third embodiment of this invention. Reference numeral 52 denotes a 50% or more circuit breaking area without magnetic fields, while reference numeral 53 denotes a substantially 100% circuit breaking area without magnetic fields. Reference numeral 54 denotes a 50% or more circuit breaking area with magnetic fields, while reference numeral 55 denotes a substantially 100% circuit breaking area with magnetic fields. FIG. 6 shows the circuit breaking area obtained when currents of $i_0$=3,500 A were interrupted in the cases in which magnetic fields were or were not applied to contacts in a DC circuit breaker, wherein the horizontal axis indicates the parallel condenser C ($\mu$F) of the commutation circuit, while the vertical axis indicates the parallel reactor L ($\mu$H) of the commutation circuit. This figure indicates that the presence of magnetic fields serves to widen the area, that is, allows the circuit to be broken easily.

Embodiment 4

Figure 7:
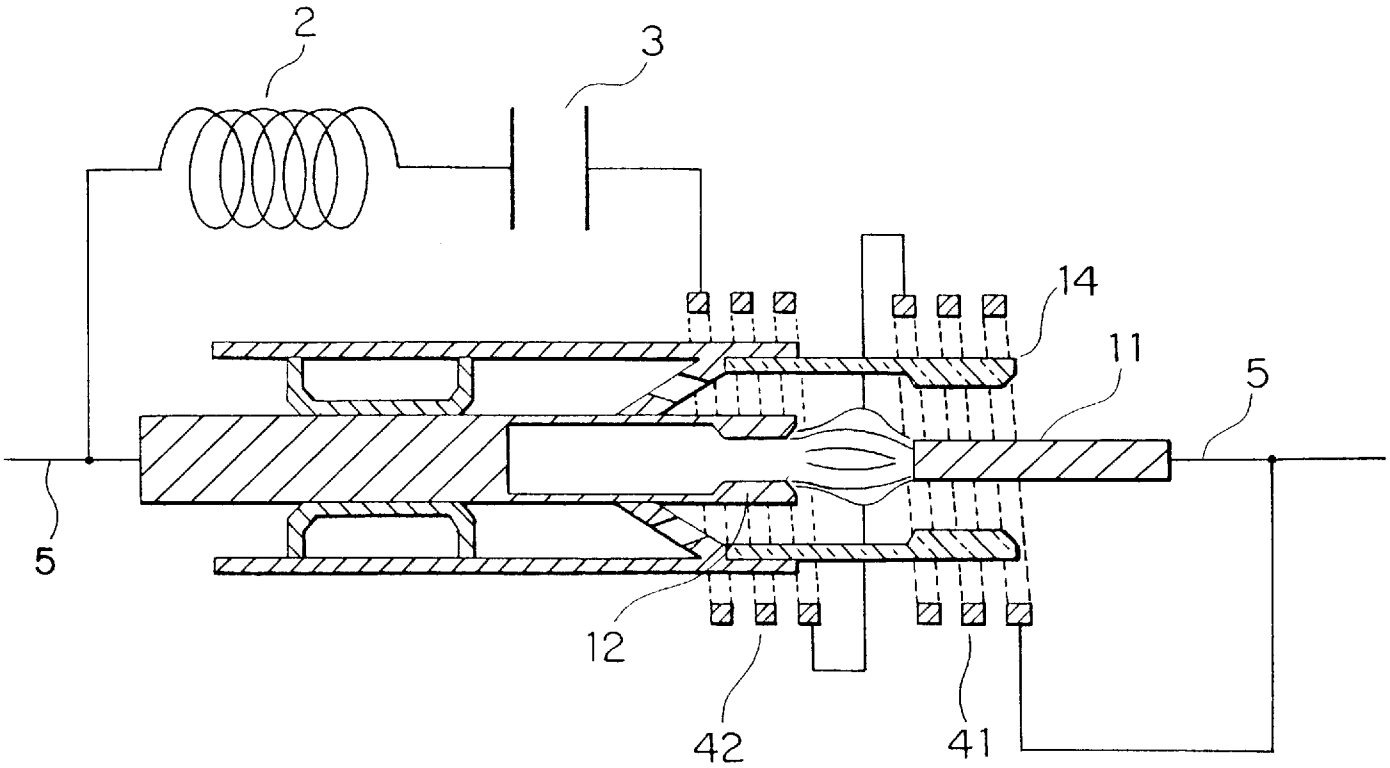
FIG. 7 is a cross sectional view showing the integral part of a DC circuit breaking device according to a fourth embodiment of this invention.

FIG. 7 is a cross sectional view showing the integral part of a DC circuit breaking device according to a fourth embodiment of this invention. In this figure, the first and the second opposed coils 41 and 42 disposed around the outer circumference of the fixed and the movable contacts 11 and 12 are wound in the same direction. The lines are connected so that currents flowing through the parallel reactor 2 and the parallel condenser 3 are allowed to flow to the DC line via the first and the second opposed coils 41 and 42. In this case, the first and the second opposed coils 41 and 42 also constitute part of the parallel reactor of the commutation circuit.

The operation of FIG. 7 is similar to that of FIG. 5 except that the commuting current causes the application of mirror magnetic fields in FIG. 7.

Embodiment 5

Figure 8:
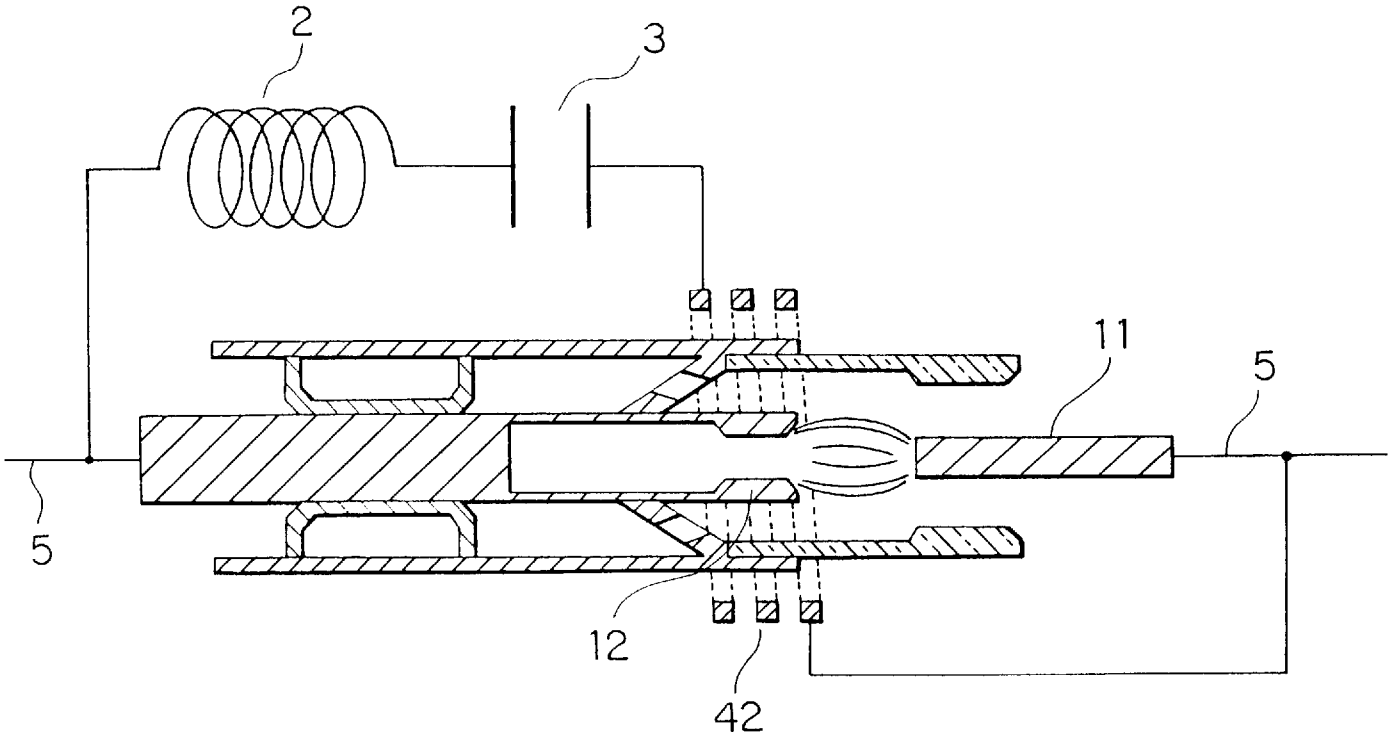
FIG. 8 is a cross sectional view showing the integral part of a DC circuit breaking device according to a fifth embodiment of this invention.

FIG. 8 is a cross sectional view showing the integral part of a DC circuit breaking device according to a fifth embodiment of this invention. In this figure, the opposed coil is disposed around the outer circumference of either the fixed contact 11 or the movable contact 12, in this case, the latter. The lines are connected so that currents flowing through the parallel reactor 2 and the parallel condenser 3 are allowed to flow to the DC line via the first and the second opposed coils 41 and 42. In this case, the opposed coil 42 also constitutes part of the parallel reactor of the commutation circuit.

The operation of FIG. 8 is similar to that of FIG. 5 except that the single opposed coil 42 use the commuting current to apply magnetic fields.

Embodiment 6

Figure 9:
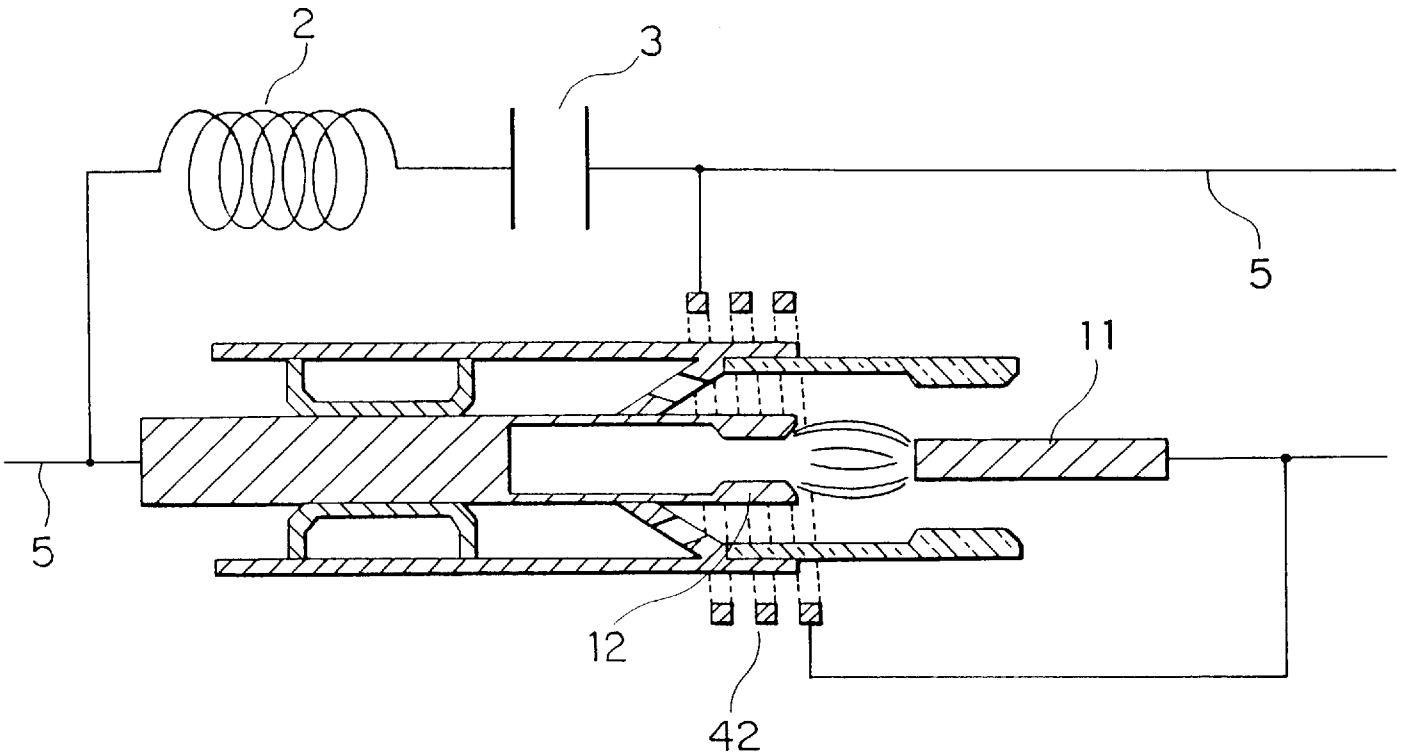
FIG. 9 is a cross sectional view showing the integral part of a DC circuit breaking device according to a sixth embodiment of this invention.

FIG. 9 is a cross sectional view showing the integral part of a DC circuit breaking device according to a sixth embodiment of this invention. In this figure, the opposed coil 42 is disposed around the outer circumference of the movable contact 12. Direct currents passing through both contacts 11 and 12 of the DC circuit breaker flow to a DC line 5 through the opposed coil 42. The commutation circuit comprising the parallel reactor 2 and the parallel condenser 3 is connected in parallel to the series body comprising the DC circuit breaker and the opposed coil 42.

Next, the operation is described. When arc currents (between the contacts 11 and 12) passing through the DC circuit breaker and varying sinusoidally are allowed to flow through the opposed coil 42, magnetic fields applied vary periodically, and an external force applied to the arc (thus, the arc voltage) also varies. Due to the variation of the external action, the extension and vibration of arc currents is initiated. When arc currents are allowed to flow through the opposed coil to apply magnetic fields, larger magnetic fields are applied by using larger arc currents. This enables an arc of a large current to be extended easily to improve the circuit breaking limit current of the DC circuit breaker.

Embodiment 7

Figure 10:
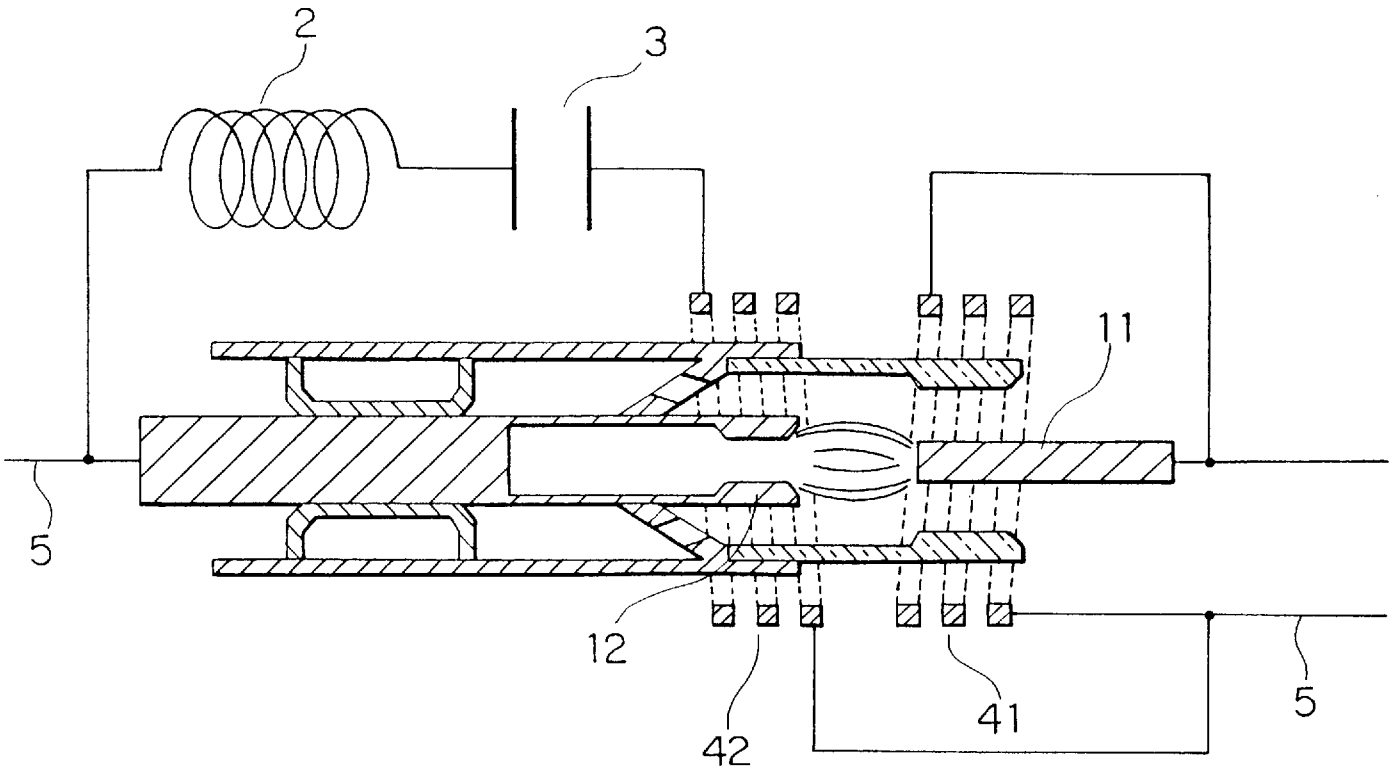
FIG. 10 is a cross sectional view showing the integral part of a DC circuit breaking device according to a seventh embodiment of this invention.

FIG. 10 is a cross sectional view showing the integral part of a DC circuit breaking device according to a seventh embodiment of this invention. In this figure, the first opposed coil 41 is disposed around the outer circumference of the fixed contact 11. Direct currents passing through both contacts 11 and 12 of the DC circuit breaker flow to the DC line 5 through the first opposed coil 41. The second opposed coil 42 is disposed around the outer circumference of the movable contact 12. The lines are connected in such a way that currents passing through the DC line 5, the parallel reactor 2, and the parallel condenser 3 are allowed to flow to the DC line 5 via the second opposed coil 42. In this case, the second opposed coils 42 constitutes part of the parallel reactor of the commutation circuit. The commutation circuit having the parallel reactor 2, the parallel condenser 3, and the second opposed coil 42 is connected in parallel to the series body comprising the DC circuit breaker and the first opposed coil 41.

In this manner, currents passing through the contacts 11 and 12 flow through the first opposed coil 41, while currents passing through the parallel reactor 2 and the parallel condenser 3 flow through the second opposed coil 42. Although not shown in FIGS. 5, 7 to 10, a surge absorber 4 shown in FIG. 29 is connected in parallel to the series body comprising the parallel reactor 2 and the parallel condenser 3.

Next, the operation is described. When currents passing through the commutation circuit comprising the parallel reactor 2 and the parallel condenser 3 and varying sinusoidally are allowed to flow through the second opposed coil 42, while arc currents (between the contacts 11 and 12) passing through the DC circuit breaker and varying sinusoidally are allowed to flow through the first opposed coil 41, magnetic fields applied vary periodically, and an external force applied to the arc (thus, the arc voltage) also varies. In particular, when different currents passing through the contact and the commutation circuit, respectively, are allowed to flow through the first and the second opposed coils 41 and 42, the external force acting on the arc varies complicatedly. Due to the variation of the external action, the extension and vibration of arc currents is initiated.

In this manner, while currents are commuted to the commutation circuit, arc currents are oscillated so as to approach their zero point, and the puffer piston 17 is used to increase the pressure of $SF_6$ gas in order to jet it against the arc from the insulating nozzle 14, thereby extinguishing the arc.

Embodiment 8

Figure 11:
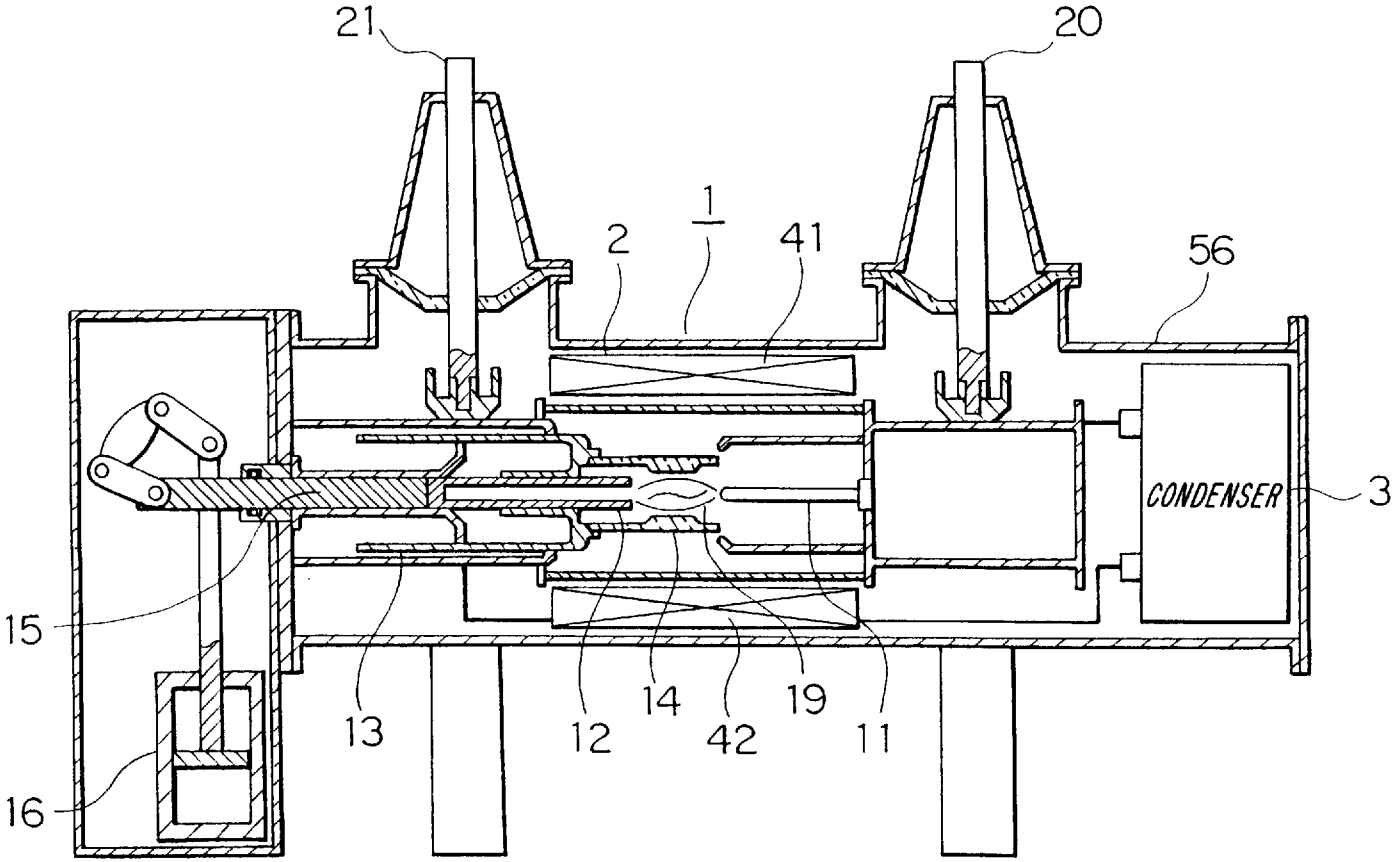
FIG. 11 is a cross sectional view showing the integral part of a DC circuit breaking device according to an eighth embodiment of this invention.

FIG. 11 is a cross sectional view showing the integral part of a DC circuit breaking device according to an eighth embodiment of this invention with the contacts 11 and 12 fully parted. In this figure, 56 is a tank for the DC circuit breaker 1, and the DC circuit breaker 1 is housed inside the tank. Reference numeral 2 designates a parallel reactor housed inside the tank 56 for the DC circuit breaker 1 and disposed around the outer circumference of the contacts 11 and 12 as fully parted so as to be opposed thereto. The parallel reactor 2 also acts as an opposed coil for applying magnetic fields to the arc generating area. Reference numeral 3 denotes a parallel condenser housed inside the tank 56 for the DC circuit breaker 1. Connections are made from the fixed contact 11 to the parallel condenser 3, from the parallel condenser 3 to the parallel reactor 2, and from the parallel reactor 2 to the movable contact.

Thus, when the contacts 11 and 12 are parted, commuting currents flow through the parallel reactor 2 in the commutation circuit to apply magnetic fields to the arc between the contacts 11 and 12. In FIG. 11, the parallel reactor 2 and the parallel condenser 3 are housed inside the tank 56 for the DC circuit breaker 1, so a compact DC circuit breaking device can be configured.

Embodiment 9

Figure 12:
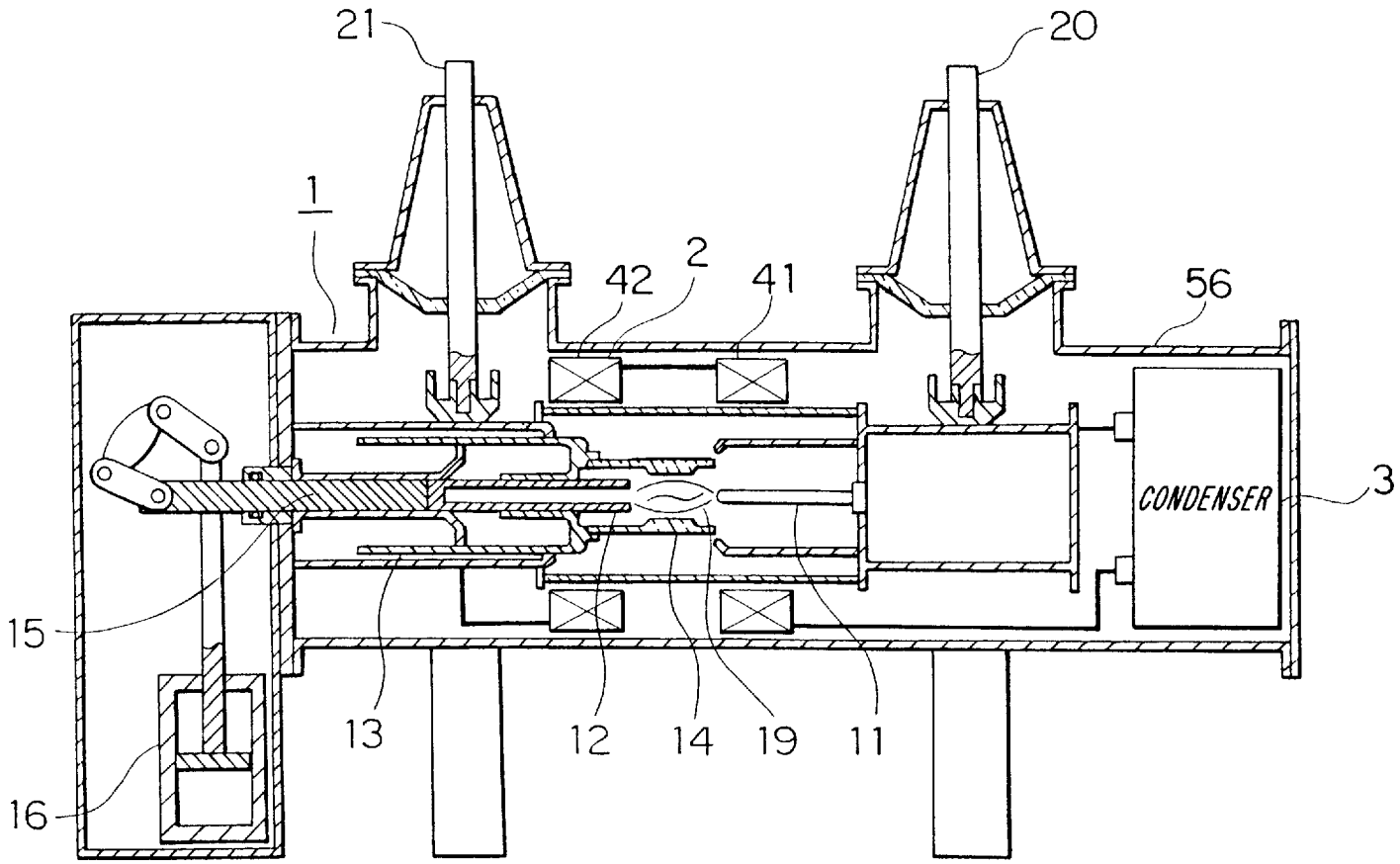
FIG. 12 is a cross sectional view showing the integral part of a DC circuit breaking device according to a ninth embodiment of this invention.

FIG. 12 is a cross sectional view showing the integral part of a DC circuit breaking device according to a ninth embodiment of this invention with the contacts 11 and 12 fully parted. In this figure, 41 is a first opposed coil disposed on the outer circumference of the fixed contact 11 so as to be opposed thereto, and 42 is a second opposed coil disposed on the outer circumference of the second contact 12 so as to be opposed thereto. The first and the second opposed coils 41 and 42 constitute the parallel reactor 2. The parallel condenser 3 and the parallel reactor 2 are housed inside the tank 56 for the DC circuit breaker 1. Commuting currents flow through the fixed contact 11, the parallel condenser 3, the first opposed coil 41, the second opposed coil 42, and the movable contact 12 in this order.

As a result, when the contacts 11 and 12 are parted, commuting currents flow through the parallel reactor 2 (the first and the second opposed coils 41 and 42) in the commutation circuit to apply magnetic fields to the arc between the contacts 11 and 12. Although FIG. 12 shows only two opposed coils, the number of opposed coils may be three or more, or only one of the first and the second opposed coils 41 and 42 may be used.

Embodiment 10

Figure 13:
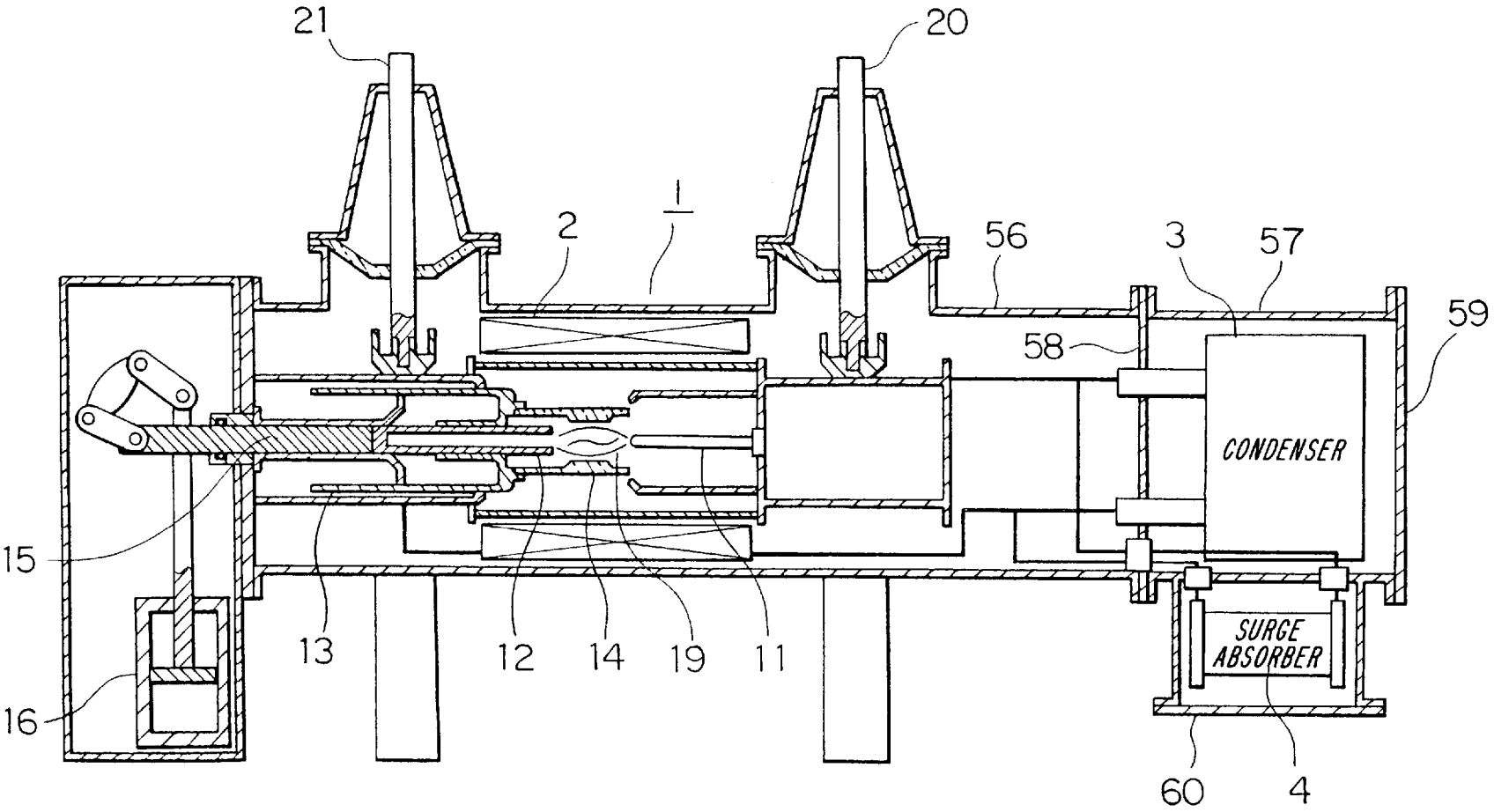
FIG. 13 is a cross sectional view showing the integral part of a DC circuit breaking device according to a tenth embodiment of this invention.

FIG. 13 is a cross sectional view showing a DC circuit breaking device according to a tenth embodiment of this invention with the contacts 11 and 12 fully parted. In this figure, 57 is a tank for the parallel condenser 3 which is connected to the tank 56 for the DC circuit breaker 1 via a partition plate 58 so as to seal the tank 56. Reference numeral 59 designates a closing door that is opened and closed when the parallel condenser 3 is housed or inspected, and 60 is a tank for the surge absorber 4 which is fixed to the tank 57. $SF_6$ gas is filled in the tank 56 and air is contained in the tanks 57 and 60. Surge absorber 4 is connected in parallel to the parallel condenser 3. Commuting currents flow through the fixed contact 11, the parallel condenser 3, the parallel reactor 2, and the movable contact 12 in this order.

Since the parallel reactor 2, the parallel condenser 3, and the surge absorber 4 are housed in the tanks 56, 57, and 60, respectively, the overall DC circuit breaking device is compact, and produces few adverse effects on the environment. Due to the sealing by the partition plate 58, $SF_6$ gas can be filled in the tank 56. Since air is contained in the tanks 57 and 60, easy maintenance is possible.

Embodiment 11

Figure 14:
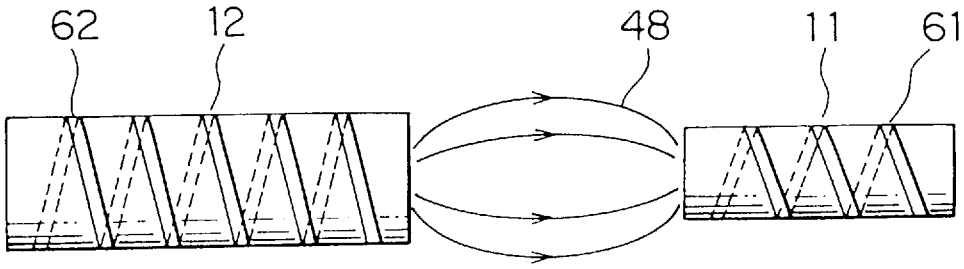
FIG. 14 is a cross sectional view showing the integral part of a contact according to an eleventh embodiment of this invention.
Figure 15:
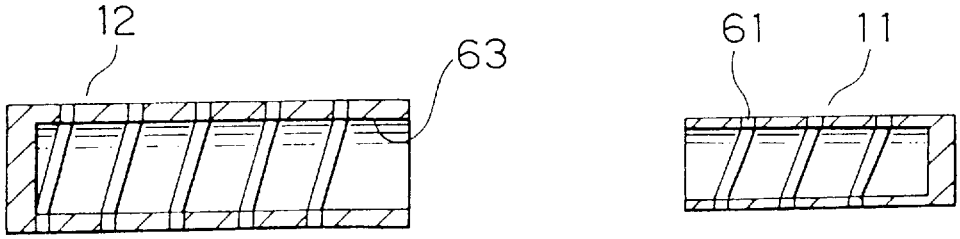
FIG. 15 is a cross sectional view of FIG. 14.

FIG. 14 is a cross sectional view showing the integral part of a contact according to an eleventh embodiment of this invention with the contacts 11 and 12 fully parted. FIG. 15 is a cross sectional view of FIG. 14. The fixed contact 11 is shaped like a cylinder one end of which is closed and in which a spiral slit 61 is formed, and the fixed contact 11 is shaped like a coil. The movable contact 12 is shaped like a cylinder one end of which is closed and in which a spiral slit 62 is formed, and the movable contact 12 is shaped like a coil. In FIG. 14, the spiral slits 61 and 62 are formed in the same direction. The inner diameter of the movable contact 12 and the outer diameter of the fixed contact 11 are adjusted so that the outer diameter of the fixed contact 11 slidably makes contact with a through-hole 63 in the movable contact 12 when the contacts are contacted.

Figure 16:
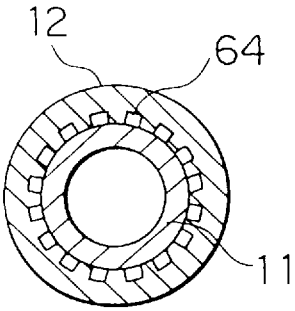
FIG. 16 is a horizontal cross sectional view of contacts 11 and 12 according to this invention as they are slidably contacted.

FIG. 16 is a cross sectional view showing the contacts 11 and 12 as they are slidably contacted, with the spiral slits 61 and 62 omitted. Pleat-like protrusions 64 are formed on the sliding surface of the movable contact 12 to ensure that electricity is conducted between the contacts 11 and 12. The pleat-like protrusions may be provided on the sliding surface of the fixed contact 11. The spiral slit may be provided in only at least one of the fixed and the movable contacts 11 and 12.

Next, the operation is described. When the spiral slit is provided in at least one of the fixed and the movable contacts 11 and 12, arc currents generated upon separation of the contacts spirally flow through these cylindrical contacts with the spiral slit to apply magnetic fields to the arc generating area. These magnetic fields change in response to the variation of arc currents, so the external force acting on the arc also varies complicatedly. This rapidly varies the arc voltage to cause the arc currents to be extended and vibrated rapidly, thereby interrupting direct currents.

In this case, by forming spiral slits 61 and 62 in the fixed and the movable contacts 11 and 12, respectively, in the same direction as shown in FIG. 14, mirror magnetic fields can be applied to the arc generating area, and act on arc currents as shown in FIG. 2. Reference numeral 48 in FIG. 14 denotes a line of magnetic force of a mirror magnetic field.

The pleat-like protrusions 64 are provided on the inner surface of the movable contact 12 and the sliding surface of the fixed contact 11. Thus, when the contacts are contacted, the buckling by the spiral slit allows the pleat-like protrusions 64 of the movable contact 12 to be pressed against the surface of the fixed contact 11, thereby ensuring that electricity is conducted between the fixed contact 11 and the movable contact 12.

Embodiment 12

Figure 17:
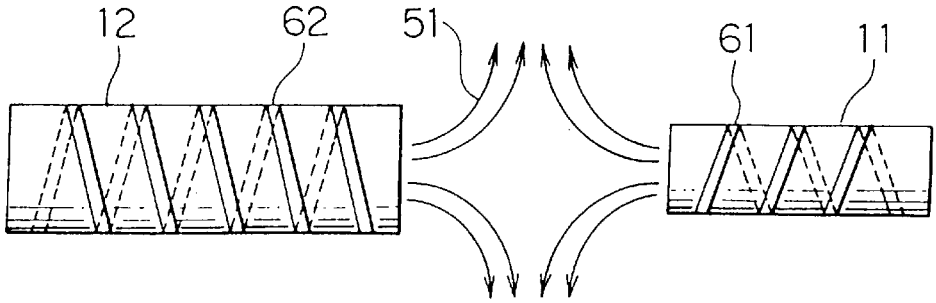
FIG. 17 is a cross sectional view showing the integral part of a contact according to a twelfth embodiment of this invention.
Figure 18:
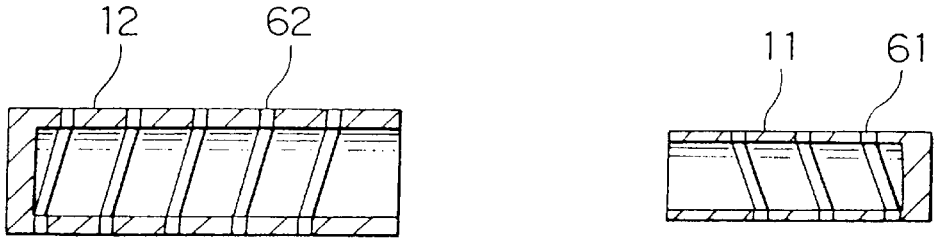
FIG. 18 is a cross sectional view of FIG. 17.

FIG. 17 is a cross sectional view showing the integral part of a contact according to a twelfth embodiment of this invention with the contacts 11 and 12 fully parted. FIG. 18 is a cross sectional view of FIG. 17. A spiral slit 61 is formed in the fixed contact 11 in one direction, whereas a spiral split 62 is formed in the movable contact 12 in the opposite direction. Thus, in FIG. 17, cusp magnetic fields can be applied to the arc generating area. Reference numeral 51 denotes a line of magnetic force of a cusp magnetic field which acts on arc currents as shown in FIG. 3.

Embodiment 13

Figure 19:
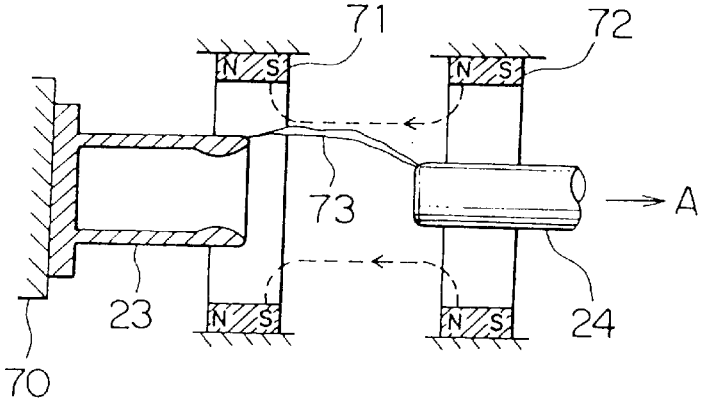
FIG. 19 is a partial cross sectional view showing the parting of contacts of a DC circuit breaker according to a thirteenth embodiment of this invention.

FIG. 19 is a partial cross sectional view showing the parting of contacts in a DC circuit breaker according to a thirteenth embodiment of this invention. In this figure, 23 and 24 are the fixed and the movable contacts, respectively, which are the same as in conventional switches. Reference numeral 70 is a fixing section for fixing the fixed contact 23; 71 is a first annular magnet disposed near the outer circumference of the contacting-side end of the fixed contact 23; 72 is a second annular magnet disposed near the outer circumference of the contacting-side end of the movable contact 24; and 73 is an arc generated upon separation of the contacts 23 and 24.

Figure 20:
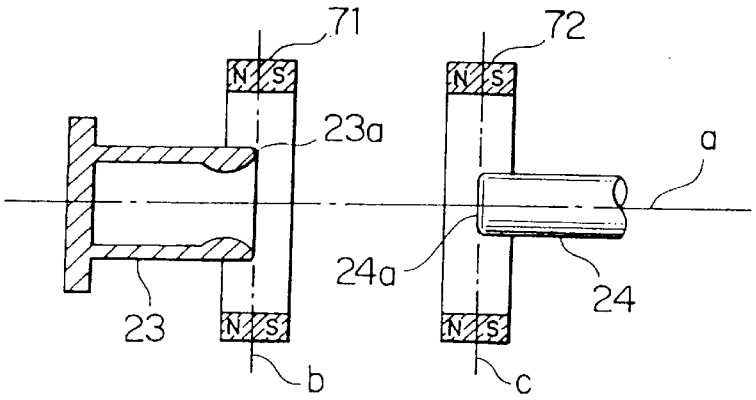
FIG. 20 is an explanatory drawing showing the locational relationship between the contacts and annular magnets according to the thirteenth embodiment of this invention.

The locational relationship between the contacts 23 and 24 and the annular magnets 71 and 72 is described in detail with reference to FIG. 20. In FIG. 20, (a) is an axis on which the movable contact 24 moves to make contact with or leave the fixed contact 23. (b) is a line extending in the contacting direction, that is, perpendicularly to the axis (a) from the contacting-side end 23*a* of the fixed contact 23. (c) is a line extending in the contacting direction, that is, perpendicularly to the axis (a) from the contacting-side end 24*a* of the movable contact 24 when the contact 24 is fully parted. The annular magnet 71 is disposed on the line (b) so as not be offset from the line (b), while the annular magnets 72 is disposed on the line (c) so as not be offset from the line (c), in such a way that the magnets are concentric relative to the axis (a). The poles of both annular magnets 71 and 72 are located in the same direction, and the N and the S poles are directed in parallel with the axis (a).

Figure 21:
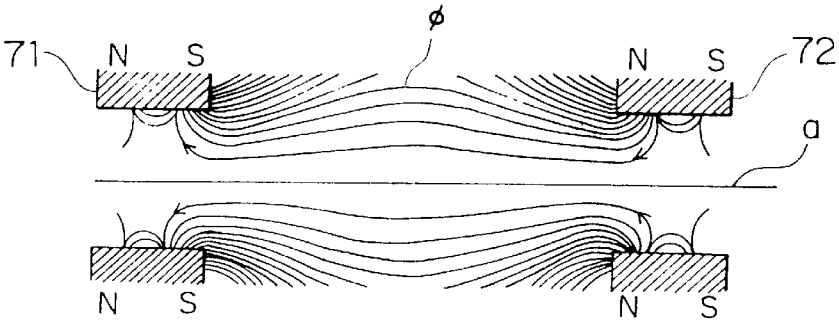
FIG. 21 shows the distribution of magnetic fields from the magnets in FIG. 19.

FIG. 21 shows the distribution of magnetic fields generated when the annular magnets 71 and 72 are disposed as described in FIG. 20. In FIG. 21, $\phi$ is a line of magnetic force. As shown in the figure, magnetic fields with a strong radial magnetic component are formed near the inner diameter of the first and the second annular magnets 71 and 72, whereas magnetic fields with a strong axial magnetic component are formed between the first and the second annular magnets 71 and 72 in the direction of the axis (a).

Next, the operation is described. When the fixed and the movable contacts 23 and 24 are in contact, a drive device (not shown) is used to drive the movable contact 24 on the axis in the direction of arrow A to initiate a parting operation. The movable contact 24 then starts parting from the fixed contact 23, thereby causing an arc 73 to be generated between the contacts. During the initial condition of the parting, magnetic fields with a radial component from the first annular magnet 71 mainly act on the arc 73. These magnetic fields and currents of the arc 73 with an axial component subject the arc 73 to a Lorentz force in the circumferential direction, thereby rotationally driving the arc.

As the parting proceeds and approaches its full condition, the movable contact 24 side of the arc 73 is subjected to a Lorentz force in the circumferential direction and rotationally driven by magnetic fields with a radial component from the second annular magnet 72 and currents of the arc 73 with an axial component. The direction of radial magnetic fields generated by the first annular magnets 71, however, is opposite to the direction of radial magnetic fields generated by the second annular magnets 72 relative to the axis, so the direction of the circumferential drive force acting on the arc 73 on its first annular magnet 71 side, that is, at the end of the fixed contact 23 is opposite to the direction of the circumferential drive force acting on the arc 73 on its second annular magnet 72 side, that is, at the end of the movable contact 24. The direction of the rotation of the arc 73 at one end is thus opposite to the direction of the rotation of the arc 73 at the other end. As a result, the arc 73 is spirally twisted, and its overall length is significantly increased.

In the middle of the arc 73, that is, between the first annular magnet 71 and the second annular magnet 72, the direction of magnetic fields is almost in parallel with the axis, as described in FIG. 21. Consequently, the Lorentz force effected by these magnets and the circumferential components of spirally extended arc currents radially and outwardly drives the arc 73. As a result, while the arc 73 is spirally twisted by the opposite driving forces acting at its respective ends, it is simultaneously driven to be radially and outwardly extended, resulting in a significant increase in its overall length.

During the parting, the arc 73 is initially rotated circumferentially by radial magnetic fields from the first annular magnet 71, and as the movable contact approaches the intermediate location between the annular magnets 71 and 72, the action of axial magnetic fields and the action of radial magnetic fields that are opposite to those from the first annular magnet 71 of the second annular magnet 72 are sequentially effected. The extension of the overall length of the arc 73 is thus initiated due to its spiralling and radial expansion.

As described above, the positioning of the contacts and magnets in the thirteenth embodiment allows the overall length of the arc 73 to be significantly increased due to its spiralling and radial expansion, thereby substantially increasing the arc voltage.

Embodiment 14

Figure 22:
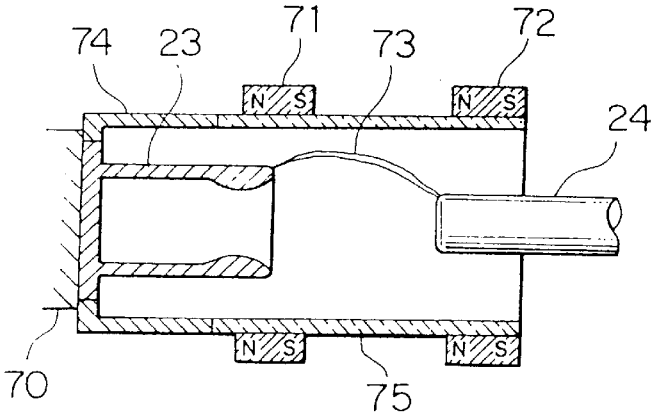
FIG. 22 is a partial cross sectional view showing the parting of contacts of a DC circuit breaker according to a fourteenth embodiment of this invention.

FIG. 22 is a cross sectional view of the parting of the contacts of the DC circuit breaker according to the fourteenth embodiment of this invention. In this figure, 74 is an outer casing secured to one end of the fixed contact 23, and 75 is a cylindrical insulating barrier secured to one end of the outer casing 74, with the first and the second annular magnets 71 and 72 mounted on its outer circumferential surface. The locational relationship between the annular magnets 71 and 72 and the contacts 23 and 24 is the same as Embodiment 13 described in FIG. 20.

Next, the operation is described. During the parting, the arc 73 generated between the fixed contact 23 and the movable contact 24 is subjected to the driving force of magnetic fields from the first and the second annular magnets 71 and 72. That is, as in Embodiment 13, the arc 73 is spirally twisted by the driving forces effected at its respective ends in the circumferential but opposite directions, while its middle is simultaneously driven to be radially extended. In this case, the insulating barrier 75 prevents the annular magnets 71 and 72 from being exposed to the hot arc 73 that is being outwardly extended.

According to this embodiment, the spiralling and radial expansion of the arc 73 serves to significantly increase its overall length in order to substantially increase the arc voltage. Furthermore, the hot arc 73 is kept from making direct contact with the annular magnets 71 and 72, thereby preventing the thermal deterioration of the magnets.

Although in FIG. 22, the annular magnets 71 and 72 have been shown to be fixed to the outer circumference of the insulating barrier 75, they may be placed outside the insulating barrier 75 and fixed to a fixed portion.

In addition, although the insulating barrier 75 has been shown as a cylinder with an opening on its movable contact 24 side, it may be made by forming on the opening side a throat portion with a through-hole into which the movable contact 24 can be inserted so as to use the inside of the insulating barrier 75 as an accumulator during parting.

Embodiment 15

Figure 23:
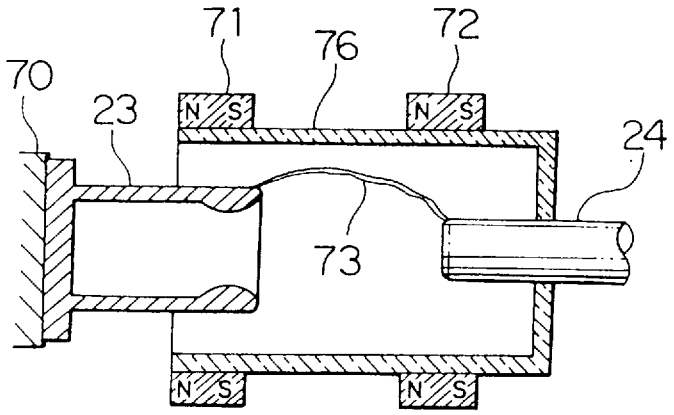
FIG. 23 is a partial cross sectional view showing the parting of contacts of a DC circuit breaker according to a fifteenth embodiment of this invention.

FIG. 23 is a cross sectional view of the parting of the contacts of the DC circuit breaker according to the fifteenth embodiment of this invention. In this figure, 23, 24, and 70 to 73 are the same as in Embodiment 14 shown in FIG. 22. Reference numeral 76 is a cylindrical bottomed insulating barrier the bottom of which is fixed to the movable contact 24, wherein the first and the second annular magnets 71 and 72 are mounted on the outer circumference of the barrier, and wherein their N and the S poles are axially directed. The relative locational relationship between the annular magnets 71 and 72 and the contacts 23 and 24 as the movable contact 24 is fully parted is as described in FIG. 20.

This embodiment differs from Embodiment 14 shown in FIG. 22 in that in Embodiment 14, the insulating barrier and the annular magnets are mounted in the fixed contact 23, while in this embodiment, they are mounted in the movable contact 24. Thus, if the fixed contact 23 is replaced with the movable contact 24, the relative relationship between the annular magnets 71 and 72 and the contacts 23 and 24 is the same as in Embodiment 14. In the parting operation, the effects of the annular magnets 71 and 72 on the arc 73 are exactly the same as in Embodiment 14, so their description is omitted.

According to this embodiment, the spiralling and radial expansion of the arc 73 cause its overall length to be significantly increased to substantially increase the arc voltage as in Embodiment 14. Furthermore, the hot arc 73 is kept from making direct contact with the annular magnets 71 and 72, thereby preventing the thermal deterioration of the magnets.

Embodiment 16

Figure 24:
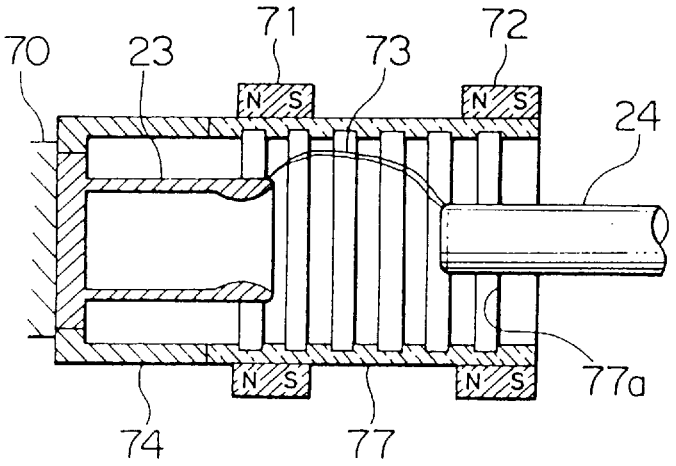
FIG. 24 is a partial cross sectional view showing the parting of contacts of a DC circuit breaker according to a sixteenth embodiment of this invention.

FIG. 24 is a cross sectional view of the parting of the contacts of the DC circuit breaker according to the sixteenth embodiment of this invention. In this figure, 23, 24, and 70 to 74 are the same as in Embodiment 14 shown in FIG. 22. Reference numeral 77 designates a cylindrical insulating barrier secured to one end of the outer casing 74, with the first and the second annular magnets 71 and 72 mounted on its outer circumference and a plurality of grooves 77*a* with a u-shaped cross section circumferentially disposed on its inner circumference.

Once the parting operation has been initiated, magnetic fields from the annular magnets 71 and 72 cause the arc 73 to be spirally twisted, while the arc is simultaneously magnetically driven to be radially and outwardly extended. The spiral hot arc 73 outwardly extended impinges on the insulating barrier 77, and is further extended due to the groove 77*a,* enabling the arc voltage to be increased.

Although in FIG. 24, a plurality of grooves with a u-shaped cross section are circumferentially provided, the cross section of the groove may be V-shaped or semicircular, or be spirally and circumferentially formed on the inner surface of the insulating barrier, or be formed in a plurality of positions on the circumference of the inner surface in parallel with the axis.

Although this embodiment has been described in conjunction with the grooves provided in the inner circumference of the insulating barrier of the same DC circuit breaker as in Embodiment 14 in FIG. 22, the same effects can be provided by providing grooves on the inner circumference of the insulating barrier of the same DC circuit breaker as in Embodiment 15 in FIG. 23.

Embodiment 17

Figure 25:
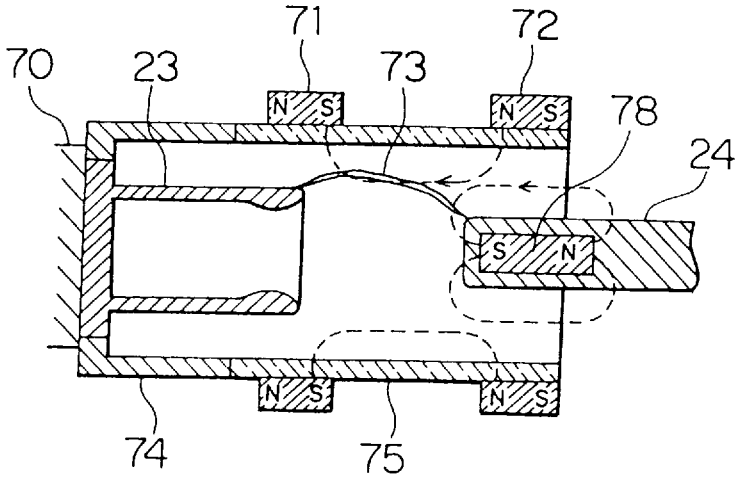
FIG. 25 is a partial cross sectional view showing the parting of contacts of a DC circuit breaker according to a seventeenth embodiment of this invention.

FIG. 25 is a cross sectional view of the parting of the contacts of the DC circuit breaker according to the seventeenth embodiment of this invention. In this figure, 23, 24, and 70 to 75 are the same as in Embodiment 14 shown in FIG. 22. Reference numeral 78 is a bar-like magnet buried into the movable contact 24 with its poles directed in the contacting direction of the movable contact 24. This magnet has an opposite polarity to the N and S poles the second annular magnet 72.

The effects of magnet fields from the annular magnets 71 and 72 on the arc 73 during the parting operation are the same as in Embodiment 14 in FIG. 22. In this embodiment, however, horizontal magnetic fields from the magnet 78 have the same direction as axial magnetic fields from the annular magnets 71 and 72 particularly in the middle of the parting, thereby further enhancing the magnetic fields and increasing the driving force that drives the arc 73 to be spirally and radially extended to further increase the arc voltage.

The magnet 78 has been described as a bar type that is buried into the movable contact 24, but it may be shaped like a ring and attached to the surface of the movable contact 24.

Although this invention has been described as the DC circuit breaker in FIG. 22 shown in Embodiment 14 with the magnet mounted at the end of the movable contact 24, it is also applicable to the DC circuit breaker in FIG. 23 or 24.

Embodiment 18

Figure 26:
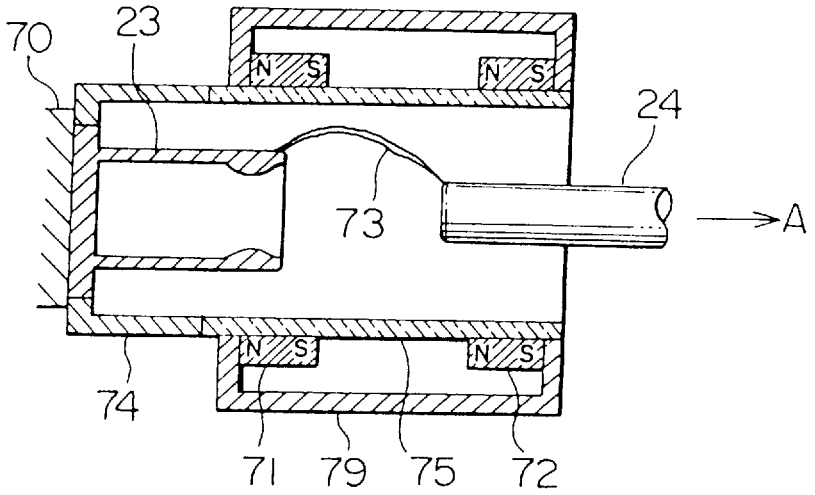
FIG. 26 is a partial cross sectional view showing the parting of contacts of a DC circuit breaker according to an eighteenth embodiment of this invention.

FIG. 26 is a partial cross sectional view showing the parting of the contacts of the DC circuit breaker according to Embodiment 18 of this invention. In this figure, 23, 24, and 70 to 75 are the same as in Embodiment 14 shown in FIG. 22. Reference numeral 79 indicates a magnetic substance that couples the respective poles of the annular magnets 71 and 72 which differ from their inner opposed poles, that is, the outer different poles on the outer circumference of the magnets 71 and 72 to form a magnetic path.

Since this embodiment forms a magnetic path from the N pole of the annular magnet 71 through the S pole of the annular magnet 72 and its N pole to the S pole of the annular magnet 71, magnetic fields between the annular magnets 71 and 72 are enhanced to further increase the magnetic driving force that drives the arc 73 to be spirally and radially extended as well as the arc voltage, compared to Embodiment 14.

Although this embodiment has been described as applicable to the DC circuit breaker according to Embodiment 14 in FIG. 22 to form a magnet path formed between the annular magnets, it is also applicable to the annular magnets of the DC circuit breaker in any of FIGS. 19 and 23 to 25.

In addition, this embodiment has been described in conjunction with the relative locational relationship between the contacts 23 and 24 and the annular magnets 71 and 72 which is set as in FIG. 20 so as to effectively increase the interaction between the arc and magnetic fields in Embodiments 13 to 18. To the extent that radial magnetic fields from each annular magnet can act on the end of the arc, however, the first annular magnet may be disposed near the outer circumference of the fixed contact 23 on its contacting side, and the second annular magnet may be disposed near the outer circumference of the movable contact 24 as fully parted.

Embodiment 19

Figure 27:
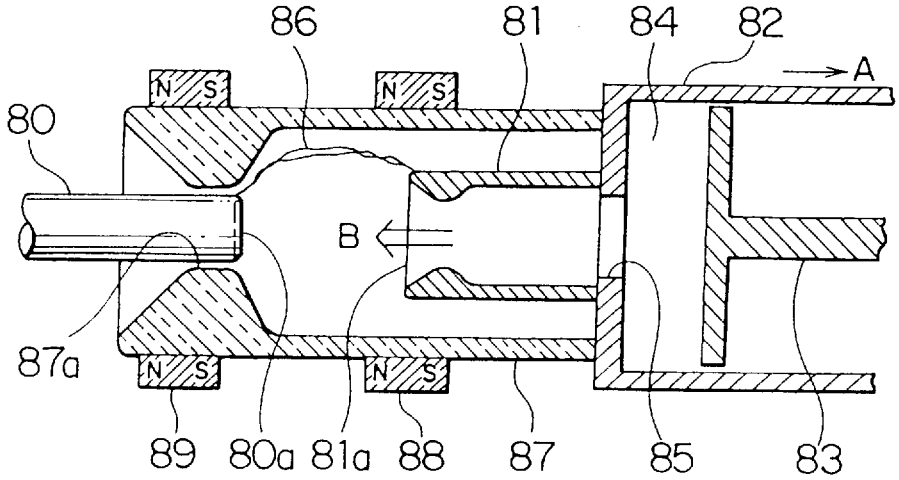
FIG. 27 is a partial cross sectional view showing the parting of contacts of a DC circuit breaker according to a nineteenth embodiment of this invention.

FIG. 27 is a partial cross sectional view showing the parting of the contacts of the DC circuit breaker according to Embodiment 19 of this invention. In this figure, 80 is a fixed contact, and 81 is a finger-like hollow movable contact that moves on the axis to make contact with or leave the fixed contact 80. Reference numeral 82 designates a cylinder interlocked with the movable contact 81, 83 is a fixed piston disposed inside the cylinder so as to slide along the cylinder 82, 84 is a puffer chamber surrounded by the cylinder 82 and the piston 83, and 85 is a gas effluence port for discharging the gas inside the puffer chamber 84 in the direction shown by arrow B to jet it against an arc 86. Reference numeral 87 denotes an insulating barrier provided so as to surround the movable contact 81 and having at one end a throat portion 87*a* penetrated by the fixed contact 80, the other end of which is secured to the cylinder 82.

Reference numeral 88 denotes a first annular magnet disposed on that outer circumference of the insulating barrier 87 which is located near the contacting-side end 81*a* of the movable contact 81. The N and S poles of this magnet are arranged in the direction in which the contacts 80 and 81 are parted. Reference numeral 89 indicates a second annular magnet disposed on that outer circumference of the insulating barrier 87 which is located near the contacting-side end 80*a* of the fixed contact 80. The N and S poles of this magnet are arranged in the same direction as in the first annular magnet 88 relative to the contacting direction.

Next, the operation is described. The interaction between magnetic fields generated by the annular magnets 80 and 81 and currents of the arc 86 drives the arc 86 to be spirally and radially expanded, as in Embodiment 13. During the parting, when a drive device (not shown) drives the movable contact 81 in the direction of arrow A together with the cylinder 82, the puffer chamber 84 is pressurized due to the fixation of the piston 83 in order to discharge an arc-extinguishing insulating gas in direction B from the gas effluence port 85 through the movable contact 81. This gas is jetted against the spirally and magnetically driven arc 86, which is further radially extended and cooled to increase the arc voltage.

Embodiment 20

Figure 28:
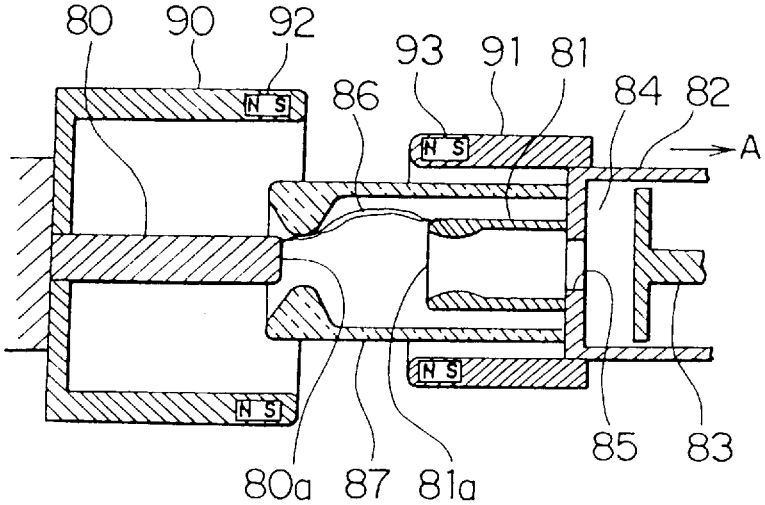
FIG. 28 is a partial cross sectional view showing the parting of contacts of a DC circuit breaker according to a twentieth embodiment of this invention.

FIG. 28 is a partial cross sectional view showing the parting of the contacts of the DC circuit breaker according to Embodiment 20 of this invention. In this figure, 80 to 87 are the same as in Embodiment 19. Reference numeral 90 denotes a cylindrical fixed-side shield one end of which is electrically connected to the fixed contact 80 so as to surround it, and 91 is a cylindrical movable-side shield electrically connected to the movable contact 81 and provided outside the insulating barrier 87 so as to surround the movable contact 81, both shields 90 and 91 serving to reduce the magnetic fields between the contacts 80 and 81. Reference numeral 92 indicates a first annular magnet buried into the fixed side shield 90 and located near the outer circumference of the contacting-side end 80*a* of the fixed contact 80. Reference numeral 93 designates a second annular magnet buried into the movable side shield 91 and located near the outer circumference of the contacting-side end 81*a* of the movable contact 81. The respective poles of both annular magnets 92 and 93 are arranged in the same direction; the N and the S poles are placed in the direction in which the movable contact 81 is contacted or parted.

Next, the operation is described. In the initial parting state, since the first annular magnet 92 is close to the second annular magnet 93, they interact to form strong magnetic field. As the parting proceeds, at the end of the fixed contact 80, radial magnetic fields from the annular magnet 92 cause the arc 86 to be rotated in the circumferential direction of the contact 80, whereas at the end of the movable contact 81, radial magnetic fields from the annular magnet 93 cause the arc 86 to be rotated in the circumferential direction of the movable contact 81. The direction of magnetic fields near the fixed contact 80 is opposite to the direction of magnetic fields near the movable contact 81, so the directions of rotation are also opposite, and the arc 86 is rapidly and circumferentially twisted and becomes spiral. In addition, the arc 86 is magnetically driven to be radially extended by the interaction between axial magnetic fields from both annular magnets 92 and 93 and circumferential current components of the spirally twisted arc 86. Thus, while being spirally twisted, the arc 86 is simultaneously magnetically driven to be radially extended. As a result, the overall length of the arc 86 is significantly extended to increase the arc voltage.

This invention has been described in conjunction with each annular magnet buried into a separate shield. Without shields, however, the movable-contact 81-side magnet may be provided in the insulating barrier 87, while the fixed-contact 80-side magnet may be disposed in an insulating barrier separately disposed in the fixed contact.

Although in Embodiments 13 to 20, the annular magnets have been disposed near the contacting-side ends of the fixed and the movable contacts, for example, sector-shaped magnets formed by circumferential division may be positioned concentrically relative to the axis.

In addition, if permanent magnets are used, the material may be ferrite, Alnico, or rare earth, and preferably has a high magnetic field strength.

In addition, although in Embodiments 13 to 20, the poles of the annular magnets have been arranged in the order of N, S, N, and S from the left end of the figure, they may be arranged in the opposite order, that is, S, N, S, and N. In this case, the direction of the rotation of the arc 73, that is, the direction of the spiral will also be opposite, but the same effects can be obtained.

According to the first invention, an opposed coil opposed to at least one of the fixed and the movable contacts is disposed around the outer circumference of the contact so as to apply magnetic fields to the neighborhood of an arc. This enables the provision of a DC circuit breaking device of high performance that enables the application of strong and varying magnetic fluxes and wherein the application of required magnetic fields varies the arc voltage to cause arc currents to be extended and vibrated rapidly in order to interrupt direct currents.

According to the second invention, since the first and the second opposed coils are wound in the opposite directions, cusp fields can be applied to the arc generating area formed on the parting of the contacts in order to perpendicularly (radially) extend the arc, thereby increasing the flight length of arc electrons. The extended arc further increases the rate at which arc current and voltage vibrations are increased, resulting in improved circuit breaking performance.

According to the third invention, since the first and the second opposed coils are wound in the same direction, mirror fields can be applied to the arc generating area formed on the parting of the contacts in order to increase the flight length of arc electrons and to radially extend the shape of the arc. The extended arc further increases the rate at which arc current and voltage vibrations are increased, resulting in improved circuit breaking performance.

According to the fourth invention, currents flowing through the commutation circuit are allowed to flow through the opposed coil in order to apply magnetic fields to the arc generating area. Thus, the commuting current becomes larger as the arc current becomes smaller, so the reduced arc can be radially extended by a large force (magnetic fields). Consequently, the circuit breaking performance is improved.

According to the fifth invention, currents flowing through the contact are allowed to flow through the opposed coil in order to apply magnetic fields to the arc generating area. Thus, larger magnetic fields are applied when the arc current is large, thereby allowing an arc of a large current to be extended easily to increase the circuit breaking limit current of the DC circuit breaker.

According to a sixth invention, currents flowing through the commutation circuit are allowed to flow through one of the opposed coils, while currents flowing through the contact are allowed to flow through the other, thereby applying magnetic fields to the arc generating area. Thus, when different currents passing through the contact and the commutation circuit, respectively, are used to apply magnetic fields, the external force acting on the arc varies complicatedly to increase the circuit breaking limit current of the DC circuit breaker.

According to the seventh invention, since the opposed coil constitutes the parallel reactor of the commutation circuit, both the magnetic field application function and the effects of the parallel reactor can be provided.

According to the eighth invention, the DC circuit breaker is housed inside the tank, and the opposed coil is also housed inside the tank. Thus, the DC circuit breaking device not only provides the magnetic field application function but is generally compact, producing few adverse effects on the environment.

The ninth invention includes the second tank with the tank closing door connected to the first tank for housing the parallel condenser inside the second tank. The overall DC circuit breaking device is thus compact, producing few adverse effects on the environment. The closing door enables the maintenance of the parallel condenser to be conducted easily.

According to the tenth invention, $SF_6$ gas is filled in the first tank for the DC circuit breaker, and the second tank is isolated from the first tank via a flange, and has air filled therein. The overall DC circuit breaking device is thus compact, producing few adverse effects on the environment, and the inside of the second tank can be inspected easily.

According to the eleventh invention, at least one of the fixed and the movable contacts is shaped like a cylinder with a spiral slit, so arc currents generated by the contacts on their parting are used to apply magnetic fields to the arc generating area. This enables the provision of a DC circuit breaking device of high performance that can vary the arc voltage to cause arc currents to be extended and vibrated rapidly in order to interrupt direct currents.

According to a twelfth invention, the fixed and the movable contacts are each shaped like a cylinder with a spiral slit, and each spiral slit is formed in the opposite direction to the other's. Arc currents generated by the contacts on their parting are thus used to apply cusp fields to the arc generating area.

According to a thirteenth invention, the fixed and the movable contacts are each shaped like a cylinder with a spiral slit, and the spiral slits are formed in the same direction. Arc currents generated by the contacts on their parting are thus used to apply mirror fields to the arc generating area.

According to a fourteenth invention, pleat-like protrusions are formed on the sliding surfaces of the cylindrical contacts with a spiral slit, ensuring that electricity is conducted through the fixed and the movable contacts.

According to the fifteenth invention, the first and the second magnets are disposed near the outer circumference of the ends of the first and the second contacts in such a way that their poles are arranged in the contacting direction and that the respective poles are arranged in the same direction. Thus, immediately after the initiation of parting, magnetic fields from both magnets and the arc interact. As the parting proceeds, radial magnet fields from the first magnet and the arc interact at the end of the first contact, while radial magnetic fields from the second magnet and the arc interact at the end of the second contact. In addition, magnetic fields parallel with the axis and the arc interact between the contacts. The arc is thus rotated at its either end in the circumferential direction of the contacts but in the opposite directions, and thus spirally twisted. Furthermore, the middle of the arc is magnetically driven to be radially extended to enable the arc voltage to be increased, thereby improving the circuit breaking performance.

According to the sixteenth invention, the first magnet is disposed near the outer circumference of the end of the first contact, and the second magnet is disposed near the outer circumference of the end of the second contact as fully parted from the first contact, in such a way that their poles are arranged in the contacting direction and that the respective poles are arranged in the same direction. Because of the interaction of the both magnets and the arc generated between the both contacts during the parting action, the arc is thus rotated at its either end in the circumferential direction of the contacts but in the opposite directions, and thus spirally twisted. Furthermore, the middle of the arc is magnetically driven to be radially extended to increase the arc voltage, thereby improving the circuit breaking performance of the DC circuit breaker, in particular, its DC circuit breaking performance.

According to the seventeenth invention, the first magnet is disposed on a line radially extending from the end of the first contact, while the second magnet is disposed on a line radially extending from the end of the second contact. Consequently, radial magnetic fields from the magnets efficiently act on the neighborhood of the ends of the contacts, causing the arc to be rotated at its either end in the circumferential direction of the contacts but in the opposite directions and to be spirally twisted. Furthermore, the middle of the arc is magnetically driven to be radially extended to efficiently increase the arc voltage, thereby improving the circuit breaking performance.

According to the eighteenth invention, the insulating barrier is provided between the first contact and the first magnet, and between the second contact and the second magnet so each magnet is prevented from being exposed to the hot arc that has been spirally and radially extended. As a result, the thermal deterioration of the magnet is prevented.

According to the nineteenth invention, since a magnetic path is formed by using the magnetic substance to couple the first and the second magnets, magnetic fields from both magnets which act on the arc are strengthened, thereby enhancing the magnetic driving force that is provided by the interaction of magnetic fields and the arc generated between the contacts and which drives the arc so as to be spirally and radially extended. Consequently, the arc voltage is further increased to improve the circuit breaking performance.

The twentieth invention provides the puffer-type DC circuit breaking device wherein the first magnet is disposed on the outer circumferential surface of the insulating barrier located near the end of the movable contact, while the second magnet is disposed on the outer circumferential surface of the insulating barrier located near the end of the fixed contact when the movable contact is fully parted, in such a way that the poles of both magnets are arranged in the contacting direction and that the respective poles are arranged in the same direction. The interaction of magnetic fields and the arc generated between the contacts causes the arc to be rotated at its either end in the circumferential direction of the contacts but in the opposite directions and to be spirally twisted, with the middle of the arc magnetically driven to be radially extended.

What is claimed is:

1. A DC circuit breaking device comprising: a DC circuit breaker having a fixed and a movable contacts to interrupt the transmission of direct currents to an electric power system; a commutation circuit connected in parallel to the DC circuit breaker including a condenser and a reactor; a surge absorber connected to parallel across the commutation circuit for absorbing a surged voltage applied to the parallel condenser; and a coil means disposed around the outer circumference of the at least one of the fixed and movable contacts when the fixed and movable contacts are fully parted so as to apply magnetic fields to an arc generating area formed upon separation of the contacts.

2. A DC circuit breaking device according to claim 1 wherein the coil means comprises a pair of coils disposed around the outer circumference of the fixed and movable contacts, respectively, the coils being wound in the opposite directions with respect to each other, and cusp magnetic fields are applied to the arc generating area formed upon separation of the contacts.

3. A DC circuit breaking device according to claim 1 wherein the coil means comprises a pair of coils disposed around the outer circumference of the fixed and moveable contacts, respectively, the coils being wound in the same direction, and mirror magnetic fields are applied to the arc generating area formed upon separation of the contacts.

4. A DC circuit breaking device according to claim 1 wherein currents flowing through the commutation circuit flow through the coil means disposed around the outer circumference of at the least one contact in order to apply magnetic fields to the arc generating area.

5. A DC circuit breaking device according to claim 1 wherein currents flowing through the at least one fixed or the movable contact flow through the coil means disposed around the outer circumference of the at least one contact in order to apply magnetic fields to the arc generating area.

6. A DC circuit breaking device according to claim 1 wherein currents flowing through the commutation circuit flow through the coil means disposed around the outer circumference of the at least one contact, while currents flowing through the other contact is allowed to flow through the coil means disposed around on the outer circumference of the other contact, thereby applying magnetic fields to the arc generating area.

7. A DC circuit breaking device according to claim 1 wherein the coil means constitutes the parallel reactor of the commutation circuit.

8. A DC circuit breaking device according to claim 1 further comprising a first tank in which the DC circuit breaker and the coil means are housed.

9. A DC circuit breaking device according to claim 8 further comprising a second tank with a tank closing door connected to the first tank for housing the parallel condenser therein.

10. A DC circuit breaking device according to claim 9 wherein $SF_6$ gas is filled in the first tank, and wherein the second tank is isolated from the first tank via a partition means, and has air filled therein.

11. A DC circuit breaking device comprising a DC circuit breaker according to claim 1, wherein at least one of the fixed and movable contacts takes the shape of a cylinder with a spiral slit formed therethrough so as to apply magnetic fields to the arc generating area formed upon separation of the contacts.

12. A DC circuit breaking device according to claim 11 wherein each of the fixed and the movable contacts takes the shape of a cylinder with a spiral slit, the spiral slits being formed in the opposite directions with respect to each other, and cusp fields are applied to the arc generating area formed upon separation of the contacts.

13. A DC circuit breaking device according to claim 11 wherein each of the fixed and the movable contacts takes the shape of a cylinder with a spiral slit formed therethrough, the spiral slits being formed in the same direction, and mirror fields are applied to the arc generating area formed upon separation of the contacts.

14. A DC circuit breaking device according to claim 11 wherein each of the fixed and the movable contacts takes the shape of a cylinder with a spiral slit formed therethrough, one of the cylinders being slidably inserted into the other, and a plurality of protrusions are formed on the sliding surfaces of the cylinders.

* * * * *